US007780276B2

(12) United States Patent
Guhse et al.

(10) Patent No.: US 7,780,276 B2
(45) Date of Patent: Aug. 24, 2010

(54) SYSTEM FOR REFILLING INKJET CARTRIDGES

(75) Inventors: Jason Guhse, Poway, CA (US); Herb Sarnoff, Escondido, CA (US); Thaddeus H. Walkowicz, Las Vegas, NV (US); Steve Szabo, Austin, TX (US)

(73) Assignee: Retail Inkjet Solutions, Inc., Escondido, CA (US)

( * ) Notice: Subject to any disclaimer, the term of this patent is extended or adjusted under 35 U.S.C. 154(b) by 1022 days.

(21) Appl. No.: 11/517,201

(22) Filed: Sep. 6, 2006

(65) Prior Publication Data

US 2007/0052740 A1 Mar. 8, 2007

Related U.S. Application Data

(60) Provisional application No. 60/715,240, filed on Sep. 7, 2005.

(51) Int. Cl.
*B41J 2/175* (2006.01)
*B41J 2/17* (2006.01)

(52) U.S. Cl. ..... 347/85; 347/86; 347/84

(58) Field of Classification Search ..... 347/85, 347/86, 84

See application file for complete search history.

(56) References Cited

U.S. PATENT DOCUMENTS 2,420,080 A * 5/1947 Huck ..... 417/248
4,516,380 A * 5/1985 Buckner et al. ..... 53/282
4,907,013 A 3/1990 Hubbard et al.
5,164,747 A 11/1992 Osada et al.
5,663,754 A 9/1997 Lorenze, Jr. et al.
5,835,108 A 11/1998 Beauchamp et al.
5,988,236 A * 11/1999 Fawcett ..... 141/130
5,993,654 A * 11/1999 Black ..... 210/198.2
6,056,386 A 5/2000 Nohata et al.
6,106,094 A 8/2000 Otani et al.
6,158,837 A 12/2000 Hilton et al.

(Continued)

FOREIGN PATENT DOCUMENTS

EP 0 771 663 A2 5/1997

(Continued)

OTHER PUBLICATIONS

Mason, Lee S. "Automated Assembly of the HP Deskjet 500C/Deskwriter C Color Print Cartridge", Hewlett-Packard Journal, Aug. 1992, 7 pages.

(Continued)

*Primary Examiner*—Julian D Huffman
*Assistant Examiner*—Sarah Al-Hashimi
(74) *Attorney, Agent, or Firm*—Knobbe, Martens, Olson & Bear LLP

(57) ABSTRACT

Systems and methods for refilling inkjet printer cartridges are described. The system includes at least one rotary valve that contains a plurality of ports and a common port. The system further includes at least one pump in liquid communication with the common port of the rotary valve. At least one ink source is in liquid communication with at least one of the ports of the rotary valve, and at least one dispensing line is connected to at least one of the ports, where the dispensing line is configured to provide ink to an inkjet printer cartridge.

22 Claims, 25 Drawing Sheets

U.S. PATENT DOCUMENTS

| | | | | |
|---|---|---|---|---|
| 6,215,557 | B1 | 4/2001 | Owens | |
| 6,224,198 | B1 * | 5/2001 | Cook et al. | 347/85 |
| 6,261,353 | B1 | 7/2001 | Doi et al. | |
| 6,273,151 | B1 | 8/2001 | Kong | |
| 6,315,383 | B1 | 11/2001 | Sarmast et al. | |
| 6,331,038 | B1 | 12/2001 | Boleda et al. | |
| 6,352,331 | B1 | 3/2002 | Armijo et al. | |
| 6,361,138 | B1 | 3/2002 | Seino et al. | |
| 6,539,985 | B2 | 4/2003 | Shinada et al. | |
| 6,568,786 | B2 | 5/2003 | Sarmast et al. | |
| 6,585,007 | B2 | 7/2003 | Kubokawa | |
| 6,616,260 | B2 | 9/2003 | Skene et al. | |
| 6,623,096 | B1 | 9/2003 | Castano et al. | |
| 6,637,853 | B1 | 10/2003 | Ahne et al. | |
| 6,644,772 | B2 | 11/2003 | Choi | |
| 6,679,577 | B2 | 1/2004 | Du et al. | |
| 6,705,694 | B1 | 3/2004 | Barbour et al. | |
| 6,729,360 | B2 | 5/2004 | Sesek et al. | |
| 6,764,155 | B2 | 7/2004 | D'Souza et al. | |
| 2001/0019343 | A1 | 9/2001 | Walker et al. | |
| 2002/0149641 | A1 | 10/2002 | Du et al. | |
| 2002/0175965 | A1 | 11/2002 | Skene et al. | |
| 2003/0007046 | A1 * | 1/2003 | Asano et al. | 347/86 |
| 2003/0081062 | A1 | 5/2003 | Kim et al. | |
| 2003/0146951 | A1 | 8/2003 | Skene et al. | |
| 2004/0046811 | A1 | 3/2004 | D'Souza et al. | |
| 2004/0046841 | A1 * | 3/2004 | Cheok | 347/85 |
| 2004/0085381 | A1 | 5/2004 | Martinez et al. | |
| 2004/0170510 | A1 * | 9/2004 | Gerhardt et al. | 417/390 |
| 2004/0263588 | A1 | 12/2004 | Ansier et al. | |
| 2004/0263589 | A1 | 12/2004 | Ansier et al. | |
| 2005/0018006 | A1 | 1/2005 | Im et al. | |
| 2005/0034777 | A1 | 2/2005 | Nicodem et al. | |
| 2005/0088495 | A1 | 4/2005 | Chan | |
| 2005/0099447 | A1 | 5/2005 | Hsu et al. | |
| 2005/0185034 | A1 | 8/2005 | Anma et al. | |
| 2006/0109320 | A1 | 5/2006 | Cutler et al. | |

FOREIGN PATENT DOCUMENTS

| | | | |
|---|---|---|---|
| EP | 1 080 918 | A1 | 3/2001 |
| WO | WO 2005/016647 | A2 | 2/2005 |

OTHER PUBLICATIONS

Monroe, Michael J. "Machine Vision in Color Print Cartridge Production." Hewlett-Packard Journal, Aug. 1992, 7 pages.
Ramora Automated Ink Jet Processing Systems, 2004, 2 pages.
Makromikro, 2004, 3 pages.
Inkjet Factory, 2004, 2 pages.
Cartucho Engineering CE22 Inkstation, 2004, 4 pages.
TB Acessorios Catalog, 2004, 4 pages.
International Search Report for PCT Application No. US2006/34662, dated Jan. 10, 2008, 10 pages.
Office Action from U.S. Appl. No. 11/516,924, dated Feb. 23, 2009.

* cited by examiner

SYSTEM FOR REFILLING INKJET CARTRIDGES

CROSS-REFERENCE TO RELATED APPLICATIONS

This application claims priority to U.S. provisional application Ser. No. 60/715,240entitled "SYSTEM AND METHOD FOR REFILLING INKJET CARTRIDGES" filed on Sep. 7, 2005, which is incorporated by reference in its entirety.

BACKGROUND OF THE INVENTION

1. Field of the Invention

This invention relates to systems for refilling inkjet printer cartridges. More specifically, this invention relates to an integrated system for refilling inkjet printer cartridges that includes a rotary valve.

2. Description of the Related Art

In the personal and business computer market, inkjet printers are very common. Inkjet printers are inexpensive, quiet, fast and produce high quality output. However, replacement cartridges can be expensive. Although some manual inkjet refilling kits are available, they can be difficult and messy for individuals to use. In addition, inkjet printer cartridges may become damaged during the refilling task, especially when performed by inexperienced users.

SUMMARY

The system, method, and devices of the invention each have several aspects, no single one of which is solely responsible for its desirable attributes. Without limiting the scope of this invention as expressed by the claims which follow, its more prominent features will now be discussed briefly. After considering this discussion, and particularly after reading the section entitled "Detailed Description of Certain Embodiments" one will understand how the features of this invention provide advantages that include more efficient refilling of inkjet cartridges.

An embodiment provides an inkjet printer cartridge refilling system. The system of this embodiment includes at least one rotary valve containing a plurality of ports and a common port. The system also includes at least one pump in liquid communication with the common port of the at least one rotary valve, and at least one ink source in liquid communication with at least one of the ports of the rotary valve. The system further includes at least one dispensing line connected to at least one of the ports, where the dispensing line is configured to provide ink to an inkjet printer cartridge.

Another embodiment provides a method of refilling an inkjet printer cartridge. The method of this embodiment includes activating a rotary valve to connect an ink source to a syringe pump, and withdrawing ink from the ink source into the syringe pump. The method further includes activating the rotary valve to connect the syringe pump to an inkjet printer cartridge, and delivering the ink to the inkjet printer cartridge.

Another embodiment provides an inkjet printer cartridge refilling system. The system of this embodiment includes means for activating a rotary valve to connect an ink source to a syringe pump, and means for withdrawing ink from the ink source. The system further includes means for activating the rotary valve to connect the syringe pump to an inkjet printer cartridge, and means for delivering the ink to the inkjet printer cartridge.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DETAILED DESCRIPTION OF CERTAIN EMBODIMENTS

Figure 1:
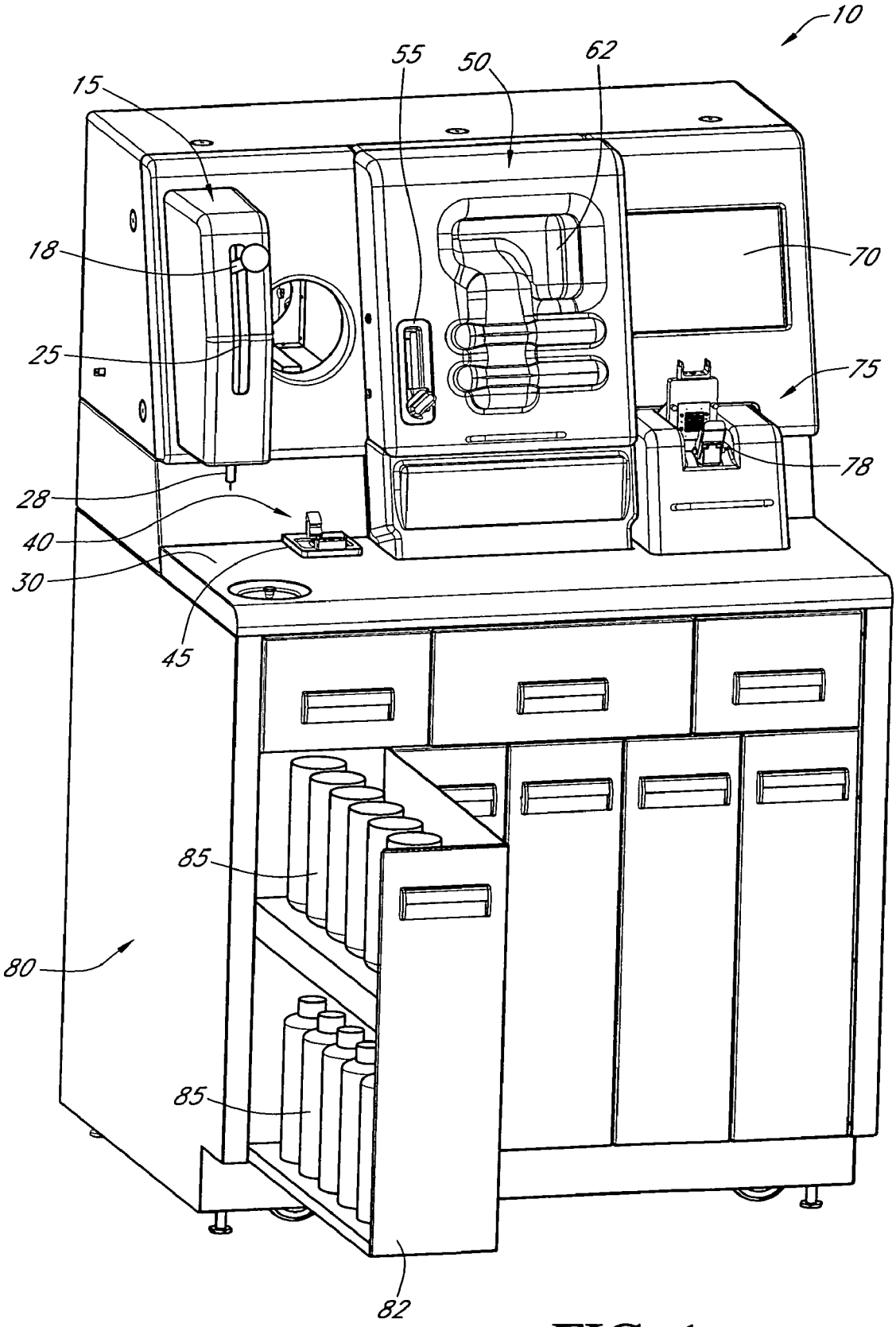
FIG. 1 is an embodiment of an inkjet refilling system.

Embodiments of the invention relate to an inkjet printer cartridge refilling system. In one embodiment, the system has a plurality of stations for refilling an inkjet printer cartridge. The system may have a drilling station for creating an orifice in the cartridge that is used within the system to introduce ink into the cartridge. The system may also have an evacuation station for removing excess ink from a used cartridge. As can be envisioned, in some cases it may be advantageous to remove the ink that remains in a used cartridge prior to refilling it with a new supply of ink. In this way the cartridge will be filled with a single type or composition of ink. In addition, removing the remaining ink can set the cartridge up for a later cleaning rinse designed to clean the interior of the used cartridge.

The system may also have an ink filling station wherein new ink is introduced into the used cartridge. In one embodiment, the system provides a vacuum chamber wherein the used cartridge is refilled. As discussed below, it may be advantageous to refill certain types of cartridges within a vacuum so that, for example, air bubbles do not remain within the cartridge after filling. In addition, it has been discovered that repeated cycling of a cartridge from a low pressure environment to a high pressure environment allows a greater quantity of ink to be introduced into the cartridge. Without being limited to any particular theory, it is believed that cycling the cartridge from a low pressure environment to a high pressure environment may allow the foam inserts within the cartridge to release trapped air that is replaced in the foam by the ink.

Embodiments of the invention include cycling the cartridge from, for example, 0.5 atmospheres (atm) to 1 atm of pressure, and back again multiple times, wherein ink is introduced following each cycle. In one embodiment, the cartridge is introduced into a vacuum chamber, and the pressure is reduced to 0.1 atm of pressure. The cartridge is filled to one-half of its maximum volume with ink, and then the pressure is released to ambient (1 atm). The system then instructs the vacuum system to reduce the pressure within the vacuum chamber to 0.5 atm, one-quarter of the maximum cartridge volume is introduced into the cartridge, and then the pressure is again released to ambient (1 atm). The system then brings the cartridge down to 0.8 atm of pressure and then introduces the final one-quarter volume into the cartridge.

However, the system is not limited to this one example of cycling the cartridge through a plurality of vacuum steps. Lowering the cartridge to other atm settings, for example, in the range of 0.05 atm to 1.0 atm is contemplated. Variation in the timing of the introduction of the ink, such as during pressure transitions, is also contemplated. In addition, fewer or additional numbers of cycles are contemplated to be within the scope of the invention.

In one embodiment of the invention, the vacuum chamber includes a door that is shaped to reduce the volume of the chamber. When the system reduces pressure within the vacuum chamber, the entire volume of the chamber is evacuated. Thus, a chamber with a greater volume takes longer to be lowered to a target vacuum pressure. Accordingly, in this embodiment, the door to the vacuum chamber provides a concave shape so that it protrudes into the chamber thereby reducing its volume. This leads to a reduced time to evacuate the chamber. It should be noted that this embodiment of the invention is not limited to any particular concave shape. In one embodiment, the door has several concave shapes that are adapted to reduce the volume within the chamber. This is described more completely with reference to FIG. 9 below.

In one embodiment, the system is a modular ink refilling system that comprises a set of fixtures or adapters that mate to receivers at each station of the system. As used herein, the term "fixture" and the term "adapter" are used interchangeably. Each fixture is designed to hold a particularly shaped and sized inkjet printer cartridge for use within the system. Accordingly, the inkjet printer cartridge, when placed within the adapter can be mated to a receiver at a station of the system. Through the use of the receivers, the system can provide a unified receiver interface to each fixture, and each fixture can be designed to hold a particular configuration of cartridge. As new cartridges are developed, additional fixtures can be manufactured to hold the cartridge and mate with the receivers. This thereby allows the system to refill newly designed cartridges without resorting to alterations in the system.

Each fixture may provide a pair of vertically oriented side support surfaces connected to one another by a back surface. Perpendicular to and disposed between upper portions of the support surfaces is a moveable top surface that swings from an open position to a closed position. In the open position, a cartridge can be introduced into the fixture, whereas in the closed position the cartridge is locked into the fixture. Alternately, a spring mounted to the back surface may be used to secure the cartridge into the fixture. A lower surface of the fixture may be open so that the nozzles from the inkjet cartridge are exposed for processing in the system. Additionally, the rear section of the inkjet printer cartridge may be exposed through the back of the fixture so that the electronic connections provided thereon are exposed to matching electronics within the system.

In one embodiment, the upper movable surface comprises one or more alignment holes positioned so that inserting a drill through the one or more alignment holes results in the creation of an ink inlet hole in the cartridge casing in a predetermined position. As is known, many inkjet cartridges are sold as sealed casings, so that it may be necessary to create one or more ink inlet holes in the cartridge casing to refill it with ink. As each cartridge has a unique size and shape, in order to refill these cartridges, the ink inlet holes may need to be created in predetermined positions. The creation of the ink inlet holes, by drilling, for example, should be done so that the cartridge is not damaged. For this reason, each cartridge may have a particular site where it is advantageous to create the ink inlet hole. By mounting the cartridge into a fixture and providing the movable top portion with one or more alignment holes, an operator of the system can create precisely positioned ink inlet holes in each different cartridge.

The location and distance of the upper movable surface above the cartridge can be selected so that the drill can be outfitted with a single drill bit that plunges a set distance. If the drill plunges the same distance, the operator does not need to know how far to insert the drill bit into the cartridge. In this embodiment, the position of the upper movable surface above the cartridge is predetermined for each fixture so that the drill bit will plunge the correct distance to create the ink inlet hole without drilling into the foam sponge material inside.

Additionally, the shape of the alignment hole can be selected so that a self-centering drill bit can be used and it will align itself properly through the alignment hole. For example, the alignment hole may be tapered so that the self-aligning bit is directed to the center of the alignment hole when the bit is lowered downward.

It should be realized that embodiments of the invention are not limited to cartridges that require creation of drilled ink inlet holes. Ink inlet holes may be created through the alignment holes using other means, such as punches, lasers, or other cutting instruments that are adapted to create a hole in the cartridge casing. In some embodiments it may not be necessary to create an ink inlet hole at all, such as for example with cartridges that are not sealed, or already have ink inlet holes. Such cartridges are still envisioned within the scope of the invention.

In another embodiment of the invention, the upper movable surface comprises one or more mounts configured to receive ink dispensers that introduce ink into the cartridge. The system advantageously may provide a plurality of ink dispensers, with each dispenser adapted to dispense a particular color of ink. In one embodiment, the ink dispensers comprise needles, and the needles are adapted to be positioned through the mounts on the upper surface of the fixture and be introduced into the cartridge. In another embodiment, the dispensers and mounts are keyed so that a particular dispenser can only be latched into a particular mount on the upper surface. By using a keyed dispenser and a matching keyed mount, an operator is unable to inadvertently place the wrong dispenser in the wrong mount. As can be imagined, one cartridge may include several different chambers, with each chamber holding a different color of ink. In order to properly refill a cartridge, the operator needs to introduce the correct color ink into the correct chamber. By keying the dispenser and the mount, the operator can be prevented from placing the wrong dispenser into the wrong mount.

Another embodiment of the invention is a fixture that has at least two movable upper surfaces. For example, the fixture may have a first movable upper surface that comprises alignment holes that are used to align a drill bit that is used to create ink inlet holes in an inkjet cartridge. The second movable upper surface may comprise mounts for receiving the ink dispensers. In this embodiment, the operator would lift the second movable upper surface so that it is moved up and away from the cartridge. The operator would then latch a cartridge into the fixture using the first upper movable surface so that the alignment holes were properly positioned above the cartridge. With the second movable upper surface out of the way, the operator could drill or punch one or more ink inlet holes in the cartridge. Following the creation of the ink inlet holes, the second movable upper surface could be lowered into place so that ink dispensers may be placed over the mounts in the second upper movable surface. If the dispenser comprises an elongated portion, such as a needle, the needle would traverse through the mounts, through the alignment holes, and into the cartridge through the ink inlet holes.

In one embodiment, the fixture comprises electrical connections so that it can communicate electronically with receivers in the system. Thus, when a cartridge is mounted into a fixture, the rearward section of the fixture comprises a series of contacts that are positioned to connect to the contacts on the rear portion of the cartridge. The outer back portion of the fixture is designed to provide a standard interface to a receiver so that no matter which fixture is placed within the receiver, the contacts are in the same position. This allows the system to control a plurality of cartridges, but only have one interface on the system.

By electrically connecting the cartridge to a receiver on the system, the nozzles on the inkjet cartridge may be fired as part of a functional test to ensure that the cartridge is working after it has been refilled. In one embodiment, the system includes a testing receiver that is adapted to electrically connect to the fixtures and run one or more test routines designed to test functionality of the cartridges. The testing receiver may be positioned next to a supply of paper that can be moved below the nozzles as they are being fired in order to create a printed test pattern. Alternatively, the testing receiver may be part of a sliding mechanism so that the cartridge is slid over the top of the paper in a similar manner to being installed in a printer. Embodiments of the system include programmed tests that are designed to determine if each nozzle is firing correctly. These tests may be printed onto paper that this then reviewed by the operator.

In one embodiment, the system includes an optical scanner that scans the test print created by the cartridge. The scanner takes an image of the test paper which is thereafter processed to determine if each nozzle is firing properly. This determination is done by analyzing the pattern of dots created by each nozzle and matching that result against a database of proper results for each type of cartridge being tested. In one embodiment, the system uses a computer-implemented algorithm to take into account factors such as the number of nozzles firing properly, the percentage firing properly, their positions on the cartridge, etc, and returns a relative score for the printing performance of the cartridge. Alternative methods could also be employed to determine if each nozzle is firing properly such as in-flight optical detection or acoustic detection.

It should be noted that embodiments of the invention are not limited to the use of fixtures. In some embodiments, the cartridge may directly mate to a receiver at a station on the system and thereby be processed. For example, in one embodiment an inkjet cartridge is mounted directly into a nozzle filling station within the system. This station may have the capability of evacuating the cartridge and thereafter refilling it through its nozzles. In one embodiment, a control system performs these tasks automatically after a nozzle refilling process is initiated on the system.

The ink refilling station may also have a plurality ink dispensers, wherein each dispenser is connected to a particular color of ink that is to be introduced into a cartridge. In one embodiment, the ink dispensers comprise needles that are adapted to be inserted into a cartridge. Once a needle is placed within a hole that was drilled into the cartridge, a syringe pump can move the proper volume of ink into the cartridge. The system may also have a test station, wherein following an ink refill, the cartridge can be tested to ensure that it is functioning properly.

Referring now to FIG. 1, an inkjet refilling system 10 is shown. The system shown is a floor-standing unit, but other configurations (e.g., a desk-top unit) are also within the scope of the invention. The system includes a drill station 15 having an actuator 18. In the embodiment shown, the actuator 18 comprises a handle on a lever. In this embodiment, an on/off switch activates the drill. Thus, when the lever is moved downward, the drill becomes active. A slide channel 25 allows the actuator to slide up and down as the drill is engaged with a cartridge.

A covered self-centering drill bit 28 protrudes from the lower portion of the drill station, and is connected to the actuator 18 so that movement of the actuator 18 within the slide channel 25 results in the covered drill bit 28 moving up and down. The drill station will be discussed in more detail with reference to FIG. 12 below.

Beneath the covered drill bit 28 is a flat surface 30 where fixtures are placed containing cartridges to be drilled. Examples of particular fixtures are discussed in detail below. Once a fixture has been placed on the flat surface 30 and aligned beneath the drill bit 28, any of several on/off switches, known in the art, can be used to activate the self-centering drill bit 28. The actuator 18 is then slid down within the slide channel 25 until the drill bit 28 drills a hole within the cartridge. In one alternative embodiment, the drill mechanism may be configured such that the drill activates and begins to spin the drill bit as soon as the handle is lowered from the top of the spring-biased upper position in the slide channel 25.

Adjacent the drilling station 15 is a cleaning station 40 which is configured to receive an inkjet printer cartridge and remove any excess ink from the cartridge prior to refilling. In this embodiment, the cleaning station 40 includes a mounting station 45 which is adapted to receive the plurality of the fixtures described above. A portion of the mounting station 45 includes an evacuation station that communicates with a vacuum source in order to evacuate the ink from any cartridge that is inserted into the mounting station 45. The cleaning station 40 is described in more detail below with reference to FIG. 5.

Within a central portion 50 of the system 10 is a nozzle refilling station 55 that is configured to receive an inkjet cartridge and refill that cartridge through its nozzles. As is known in the art, inkjet printer cartridges eject ink from a set of nozzles. In some cases it is possible to refill or clean inkjet cartridges by forcing ink or cleaning solutions into the cartridge through the nozzles. One example of such a cartridge is the Hewlett Packard Model HP45 inkjet printer cartridge. When the cartridge is placed within the nozzle refilling station 55, the system forces a predetermined quantity of ink into the cartridge through the nozzles. In one embodiment, the nozzle refilling station 55 also includes a vacuum source so that prior to nozzle filling the inkjet cartridge it can be evacuated to remove any unused ink. In this manner the system knows the proper amount of ink to use in refilling the cartridge. In another embodiment, the nozzle refilling station 55 includes a wash solution source that can be used to rinse the interior of the cartridge prior to refilling. Wash solution may include sterile filtered water, or a cleansing solution adapted for cleaning inkjet cartridges. More information on the nozzle refilling station 55 can be found in FIG. 6.

Figure 9:
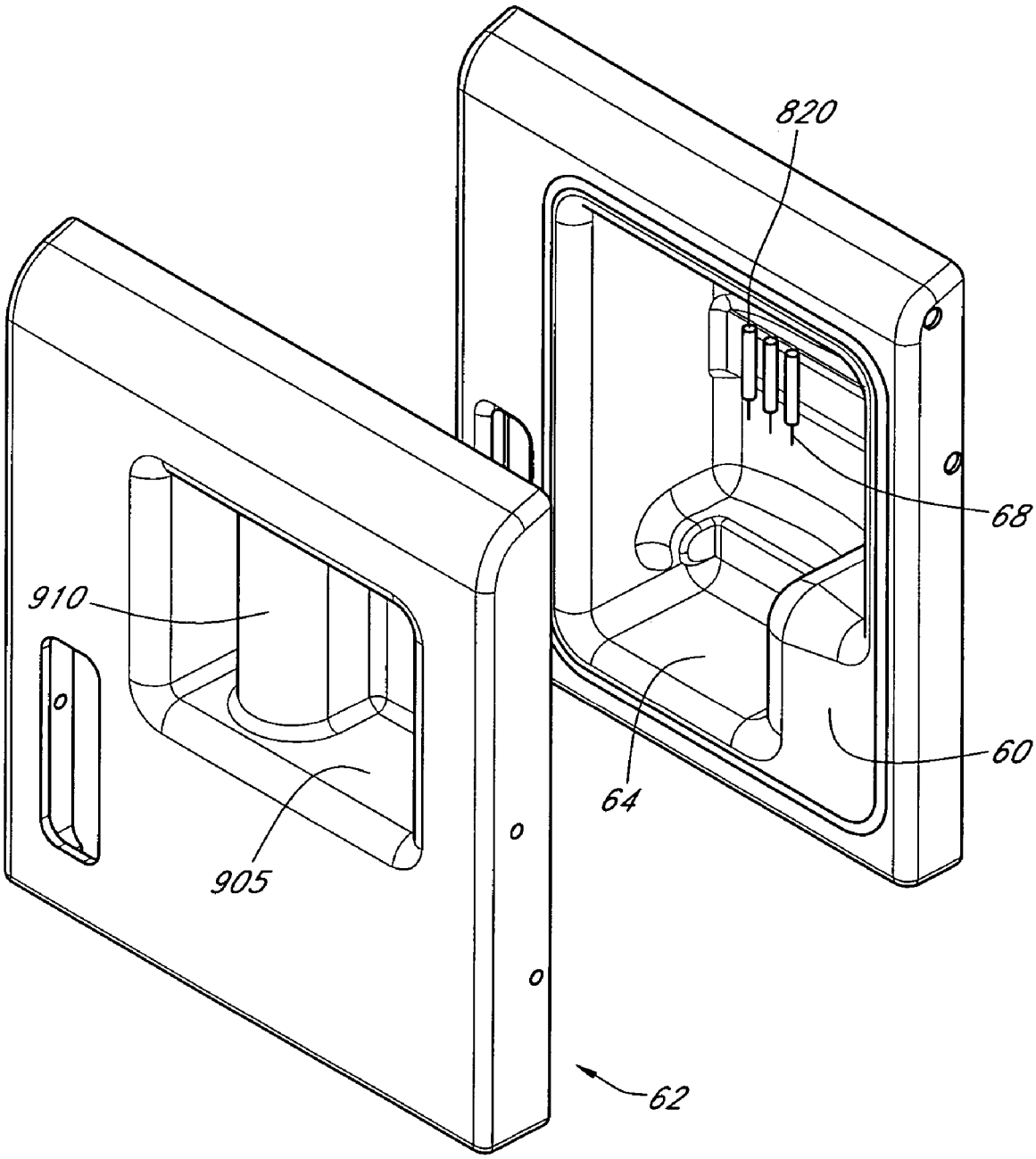
FIG. 9 is an exploded view of an embodiment of a vacuum chamber and an associated concave door of the inkjet refilling system of FIG. 1.

FIG. 9 is an exploded view of an embodiment of a vacuum chamber and an associated concave door of the nozzle refilling station 55 of FIG. 1. Referring to FIGS. 1 and 9, within the central portion 50 of the system 10, is a vacuum chamber 60 which provides a low pressure environment for refilling inkjet cartridges. Covering the chamber 60 is a concave door 62 that seals the chamber 60 when closed to allow a pressure a low pressure environment to be created within the chamber. In one embodiment, the concave door 62 is shaped to minimize the time it takes to create a low pressure environment by reducing the volume within the chamber 60.

Within the chamber 60 is a refill mounting station 64 which is adapted to hold the fixtures discussed above. As will be described below in reference to FIG. 4, each fixture may include an upper portion having through holes adapted to receive one of a set of ink refill needles 68. Each refill needle 68 is in liquid communication with an ink source and thus supplies ink to the cartridge.

Adjacent the central portion 50 is a control interface 70 which is used by the operator to control each step in the refilling process. In one embodiment, the control interface comprises a touch screen graphical user interface. The control interface is linked to a central computer system (not shown) that controls all of the functions of the system 10. By inputting commands through the interface 70, an operator can perform the functions described herein.

Below the interface 70 is a test station 75 which includes a test fixture or receiver 78 for holding a cartridge fixture or adapter. The test station 75 is used to test each cartridge after it has been refilled and thereby ensure that it is functioning properly before it is re-installed into a printer. Additional details in the test station 75 are described with reference to FIG. 10 below.

Within a lower portion 80 of the system 10 is a drawer 82 that provides a series of ink refill bottles 85. These bottles provide the source of ink used within the system to refill the inkjet cartridges. FIGS. 2A through 2E are various perspective and cross sectional views of the ink refill bottles 85 placed in an ink reservoir. As shown in FIG. 2, each bottle 85 is positioned upside down so that a septum cap 88 is placed within one of a series of ink reservoirs 89 which have interconnection regions or openings 90 adapted to mate with the bottle 85. In this embodiment of the invention, each reservoir 89 has an opening 90 configured to receive the bottle cap 88. Protruding within the opening 90 is a needle 94 that traverses the lower wall of the opening 90. When the bottle is placed within the opening 90, the needle punctures a septum 91 of the septum cap 88 and allows the ink to flow into the interior space 98 of a tank or housing 100 configured to hold a supply of ink from the bottle 85.

Figure 2A:
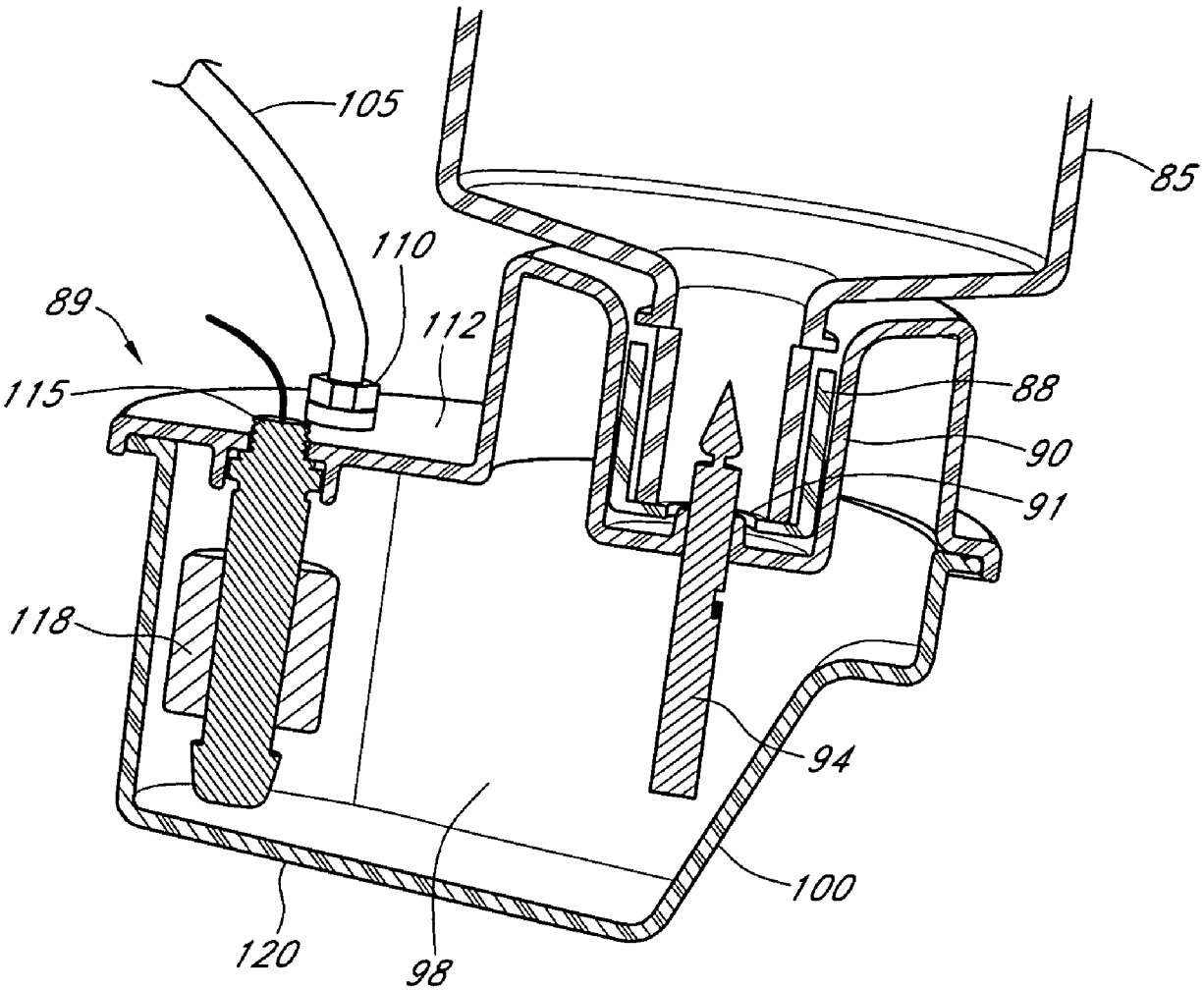
FIG. 2A is a cross sectional view of an embodiment of an ink reservoir for receiving a ink bottle comprising a septum cap.
Figure 2B:
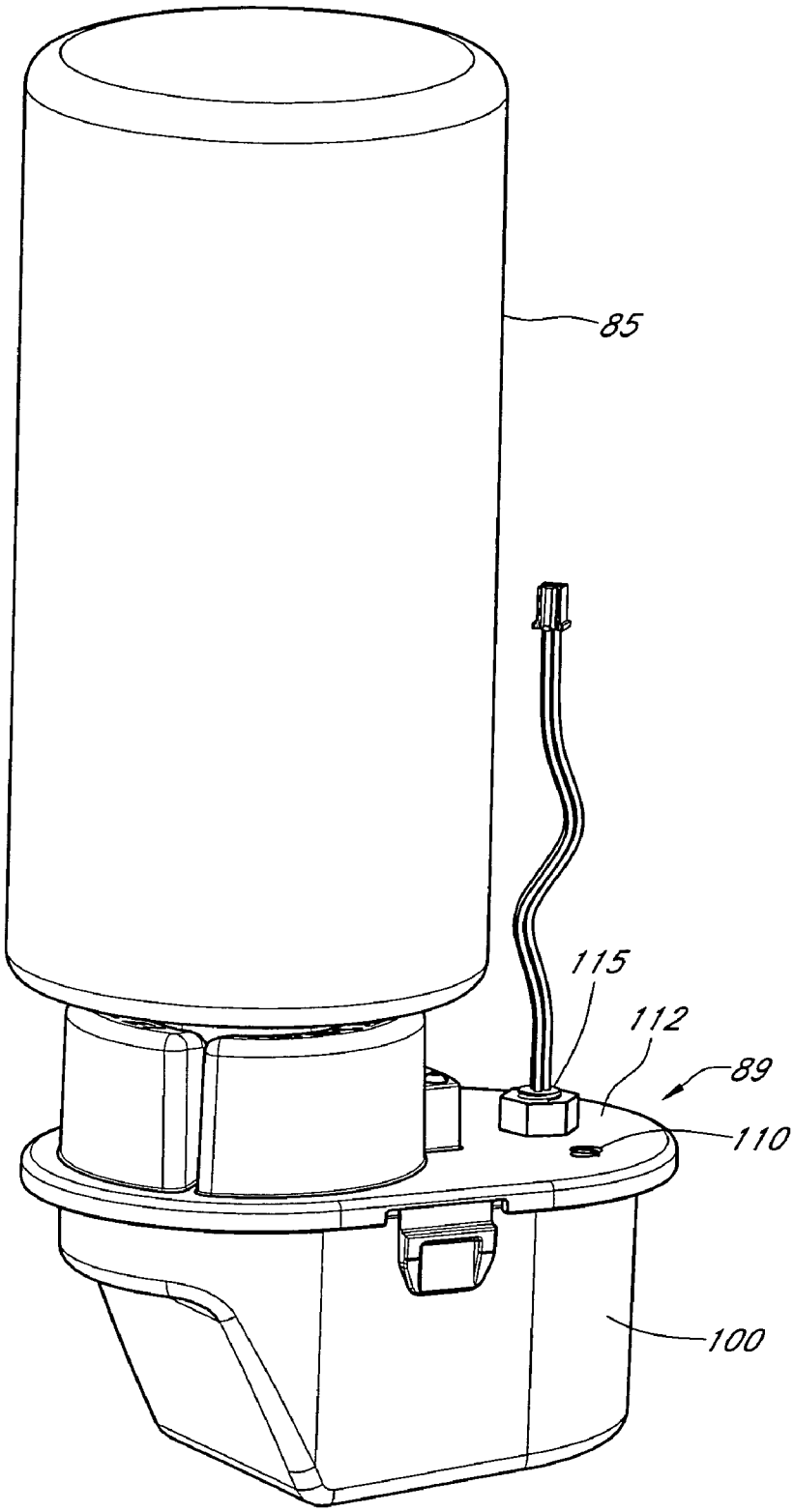
FIG. 2B is a perspective view of the ink reservoir of FIG. 2A with a septum bottle.
Figure 2C:
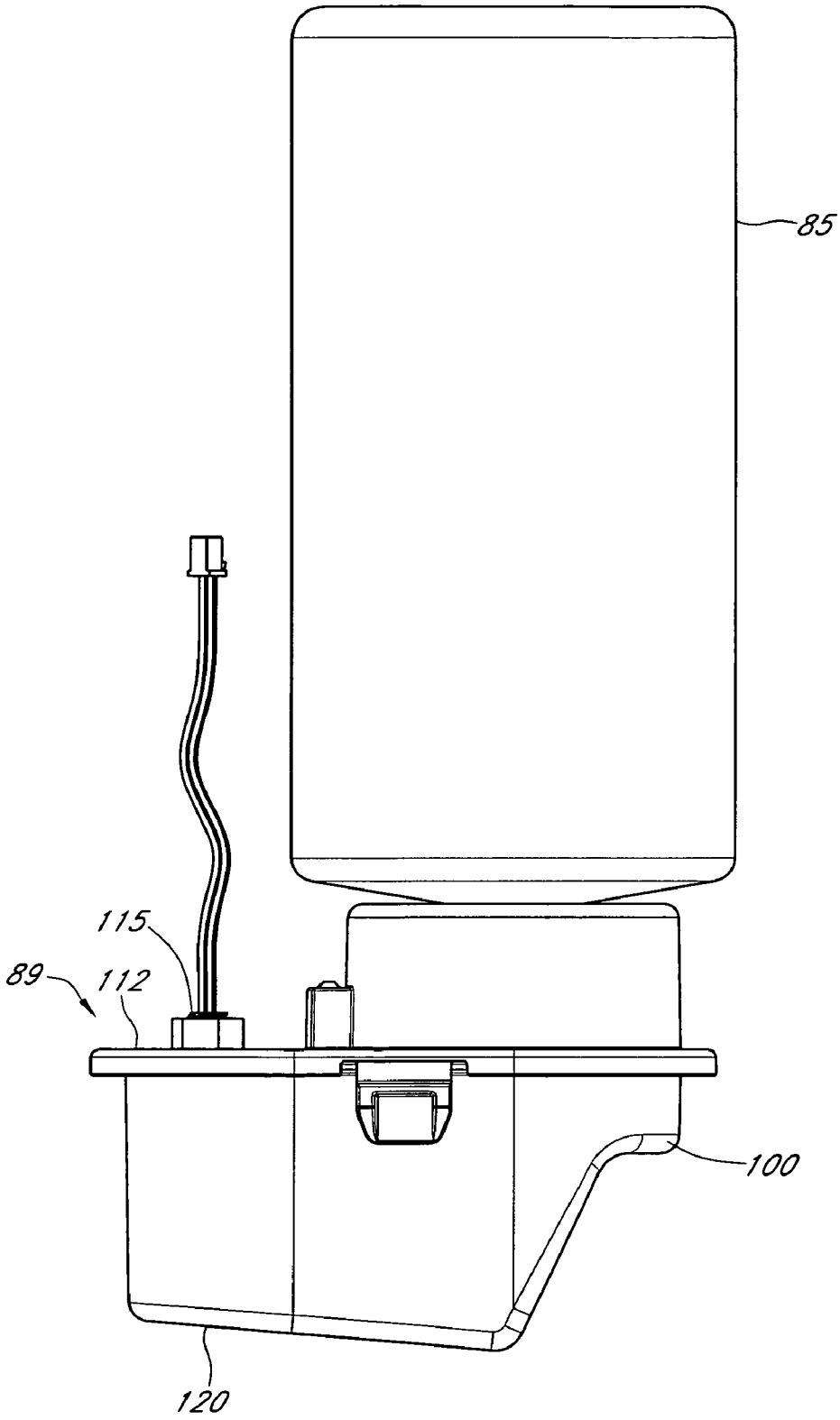
FIG. 2C is a side view of the ink reservoir and septum bottle of FIG. 2B.
Figure 2D:
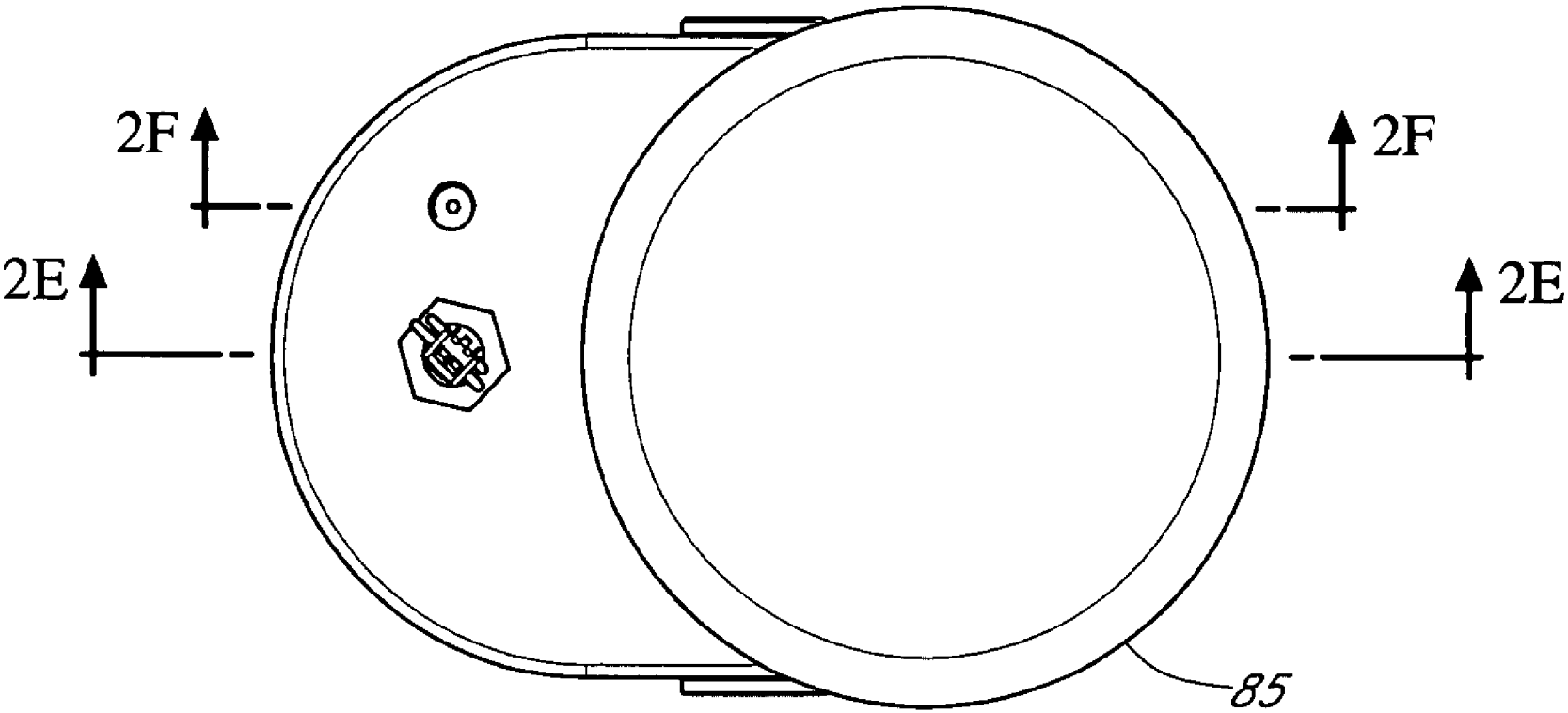
FIG. 2D is a top view of the ink reservoir and septum bottle of FIG. 2B.
Figure 2E:
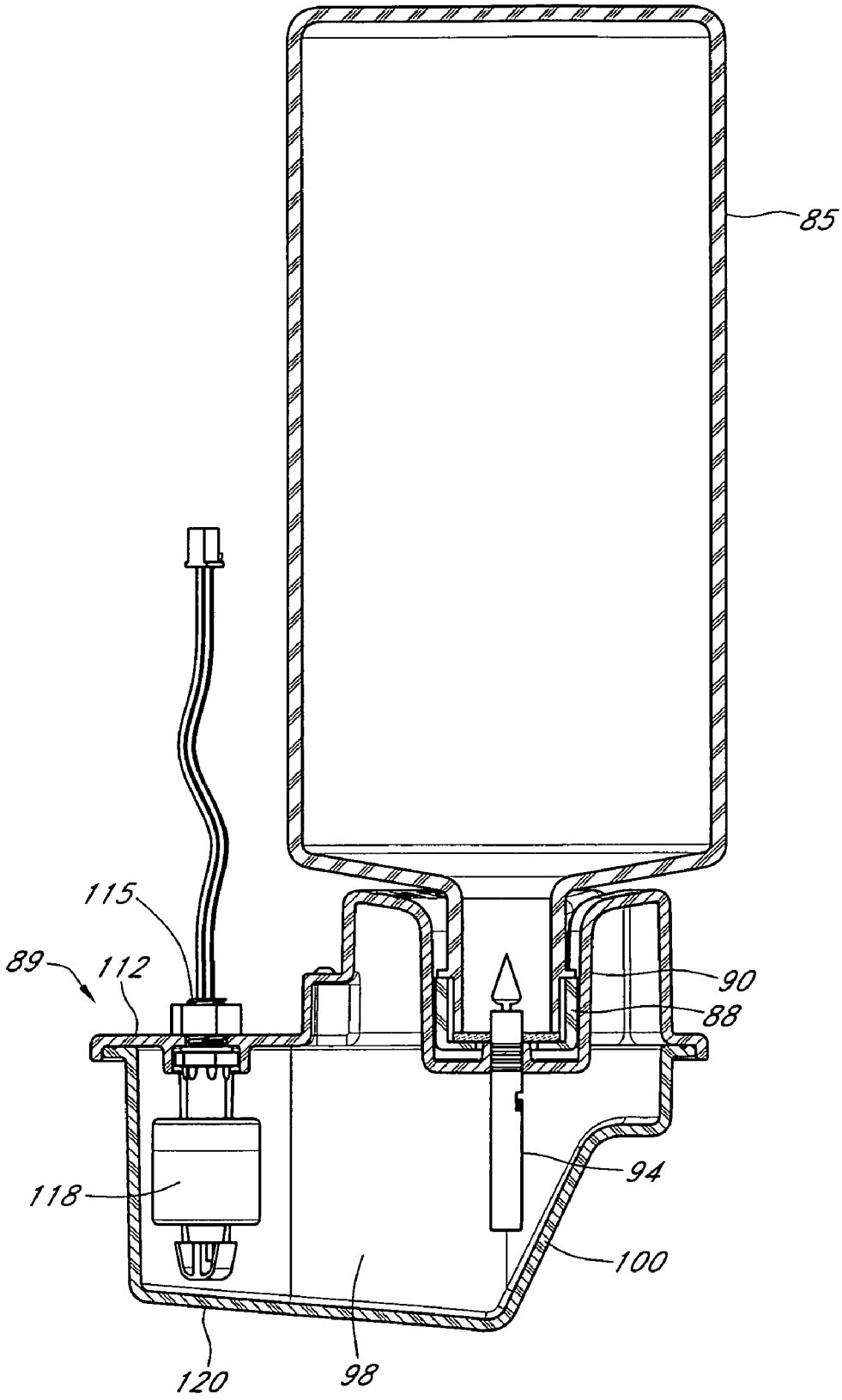
FIG. 2E is a cross-sectional view of the ink reservoir and septum bottle at the location indicated by the line E-E of FIG. 2D.
Figure 2F:
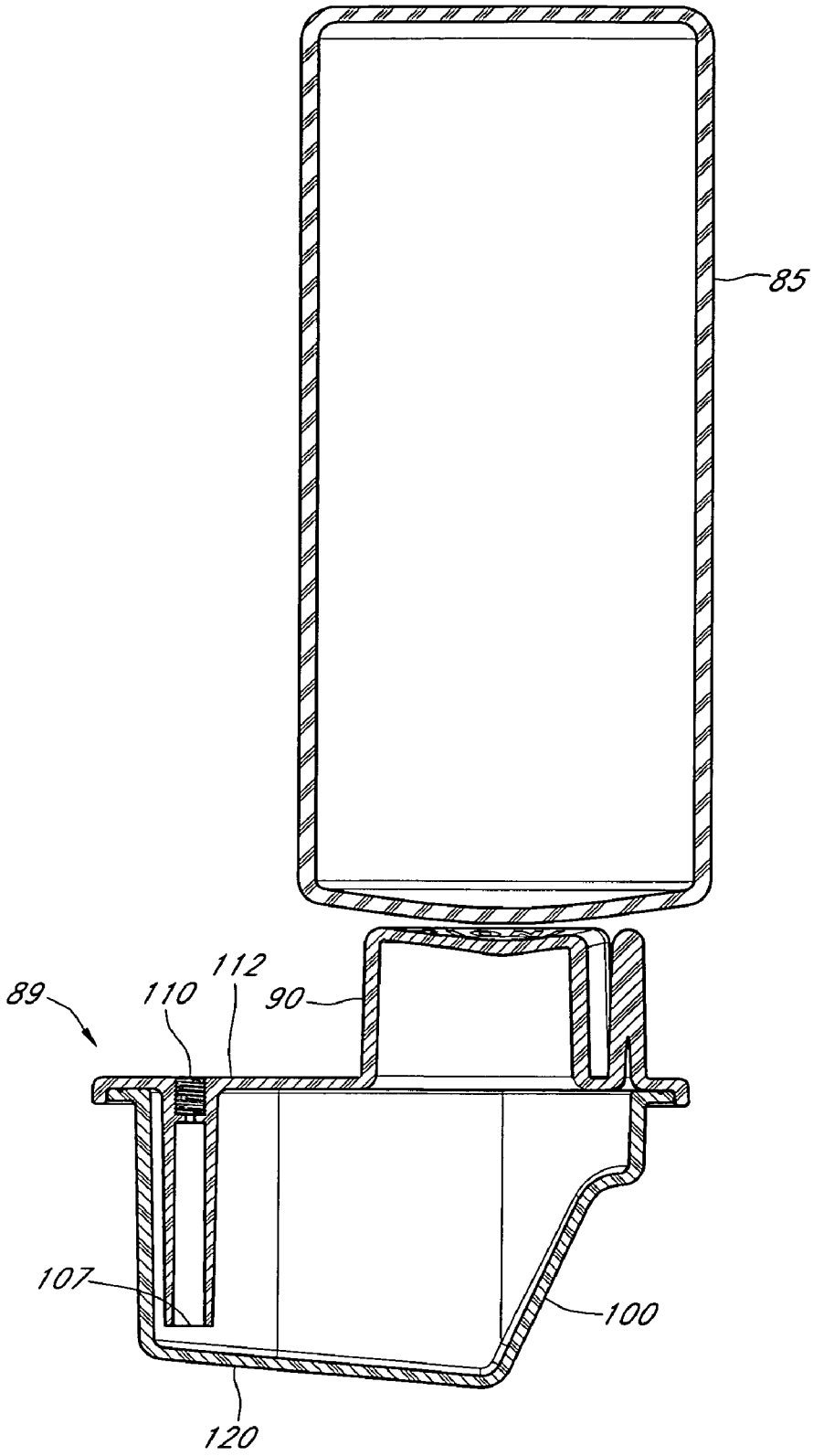
FIG. 2F is a cross sectional view of the ink reservoir and septum bottle at the location indicated by the line F-F of FIG. 2D.

As shown in FIG. 2A, the reservoir 89 also includes an ink supply tube 105 that traverses an opening 110 in an upper surface or lid 112 of the reservoir. The ink supply tube communicates ink from the reservoir 89 to a series of pumps and valves within the system 10 that will be discussed more completely with reference to FIGS. 7 and 8 below. In other embodiments, the opening 110 may be positioned in another portion of the reservoir 89 (e.g., a bottom or side surface).

Also shown in FIGS. 2A to 2D, the upper surface 112 of the reservoir 89 also includes a level sensor 115 which connects to the main system in order to alert the system if the ink level within the reservoir 89 drops below a predetermined threshold. A float 118 (see FIGS. 2A and 2E) rises and lowers as the volume of ink within the reservoir changes, and the level sensor 115 senses the position of the float 118 to determine how much ink is within the reservoir 89. The level sensor 115 can be positioned vertically relative to an inlet 107 (see FIG. 2F) of the ink supply tube 105 such that an alert indicating a low ink level condition occurs while there is still sufficient ink above the inlet 107 of the ink supply tube 105 to ensure that no air is drawn into the inlet 107 for at least one complete cartridge filling process. In one embodiment, the level sensor 115 is a model VCS-04 sensor manufactured by Gentech International Ltd. (Girvan, Scotland).

In one embodiment, a bottom surface 120 of the reservoir 89 is angled away from the inlet 107 of the ink supply tube 105 so that when the reservoir 89 is mounted into the drawer 82 any particulate matter that may be within the ink would fall away from the inlet 107 of the ink supply tube 105 and towards the needle 94.

Figure 3B:
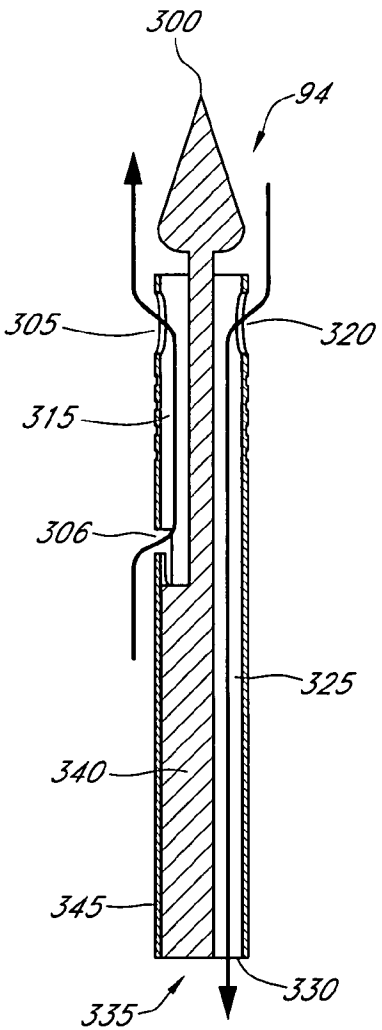
FIGS. 3A and 3B are a perspective view and a sectional view of an embodiment of an ink flow needle.
Figure 3A:
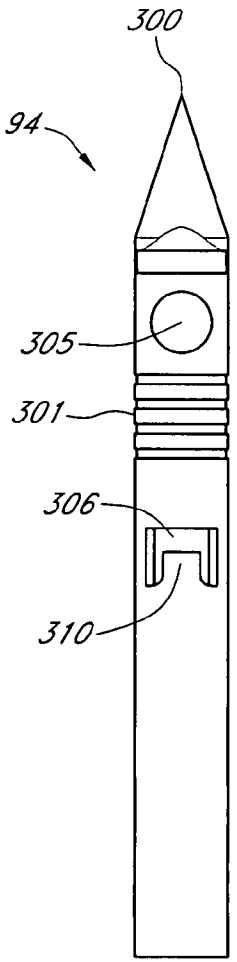

Referring to FIG. 3A, a perspective view of one side of an embodiment of the needle 94 is shown. The needle 94 includes a sharp tip 300 that is adapted to pierce the septum cap of an ink refill bottle. Below the tip 300 is an air access opening 305 that exhausts air into the ink refill bottle from an air inlet opening 306, which is open to the air pocket inside of the reservoir 89. This air flow into the ink refill bottle replaces the volume of ink which flows out of the ink refill bottle and into the reservoir 89, through a channel on the opposite side of the needle 94, described below. Below the air access opening 305 is a series of external features 301 located where a lower wall of a reservoir opening 90, formed in the upper surface 112, is bonded to the needle 94. In addition, an assembly tab 310 is shown protruding into the air inlet opening 306. This tab is bent inward during assembly of the different portions of the needle 94 to prevent the portions from coming apart and also to ensure proper that they properly align with one another.

As shown in FIG. 3B, a cross-sectional view of the needle 94, the needle comprises several openings and channels. The needle 94 has an air inlet opening 306 which allows air from the interior of the reservoir 89 to flow through an air channel 315 and exit into the bottle through the air access opening 305. The needle 94 also has an ink inlet 320 opposite the air access opening 305 which allows the ink to enter an ink channel 325 within the needle 94. The ink exits from the needle through an ink outlet 330 which is near a bottom end 335 of the needle. In some embodiments, the air access opening 305 and the ink inlet 320 are the same opening, or are connected to the same opening. In some embodiments, the ink outlet opening is on the side of the needle.

When ink levels are very low within the reservoir 89, air enters the air inlet 306, traverses the air channel 315 and enters the bottle at the air access opening 305. When the air enters the bottle it allows ink to flow into the ink inlet 320, through the ink channel 325 and out the ink outlet 330. However, as ink levels rise in the reservoir 89, they will eventually cover the air inlet 306. Once the air inlet 306 has been covered, air is no longer introduced into the bottle, and the flow of ink stops. As the ink levels drop again, air may begin to enter the air inlet 306, which thereby allows more ink to flow into the reservoir 89.

The needle 94 of FIGS. 3A and 3B is comprised of two parts, an inner shaft 340 and an external sleeve 345. The inner shaft 340 is machined from a solid piece to create the tip 300, space for the air passageway 315, and space for the longer ink passageway 325. During assembly, the external sleeve 345 is aligned below the inner shaft 340 and slid into place. The two parts are held together and in proper alignment by bending the assembly tab 310 inward.

Figure 3C:
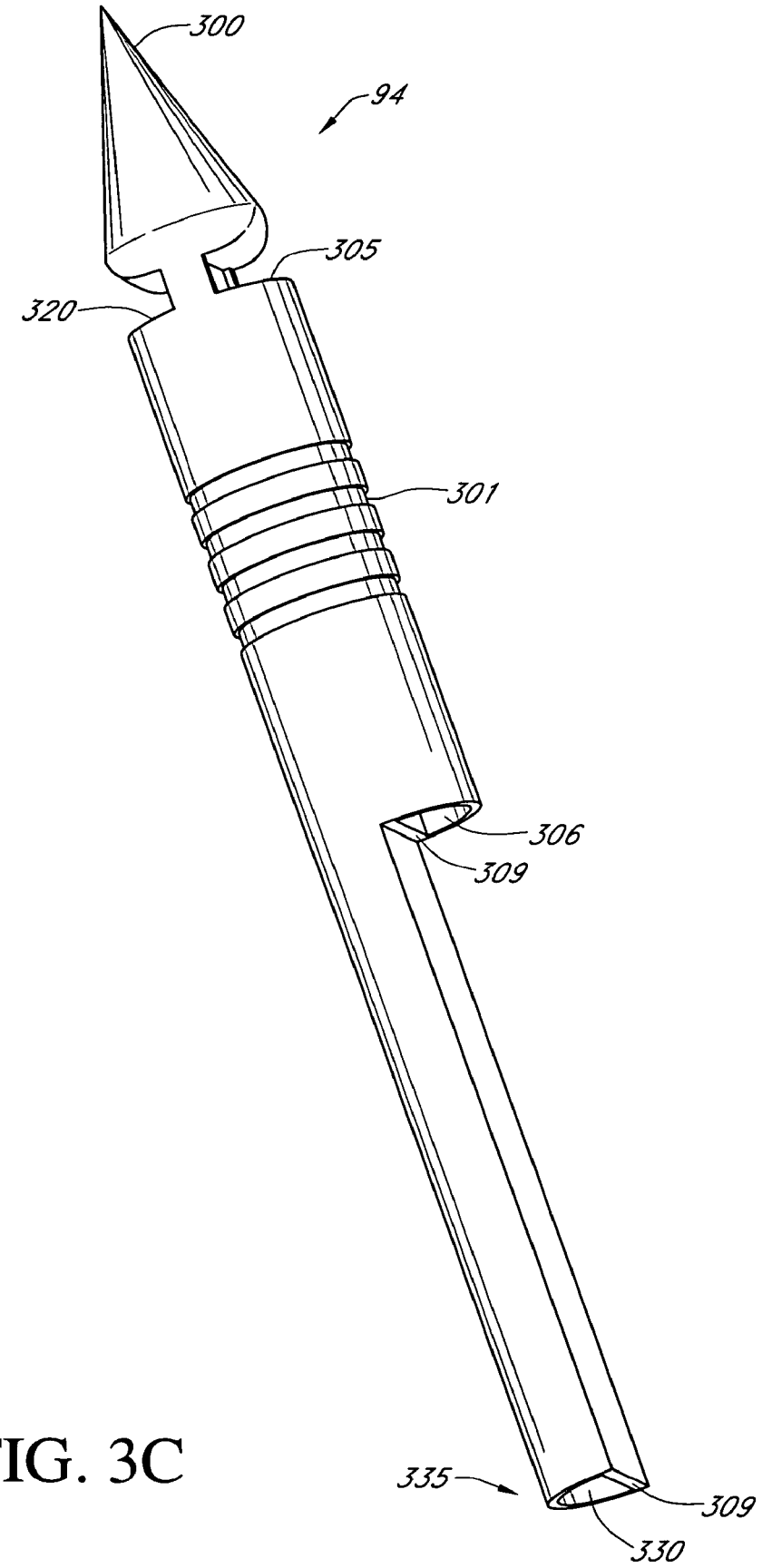
FIGS. 3C to 3E are perspective views of another embodiment of an ink flow needle.
Figure 3D:
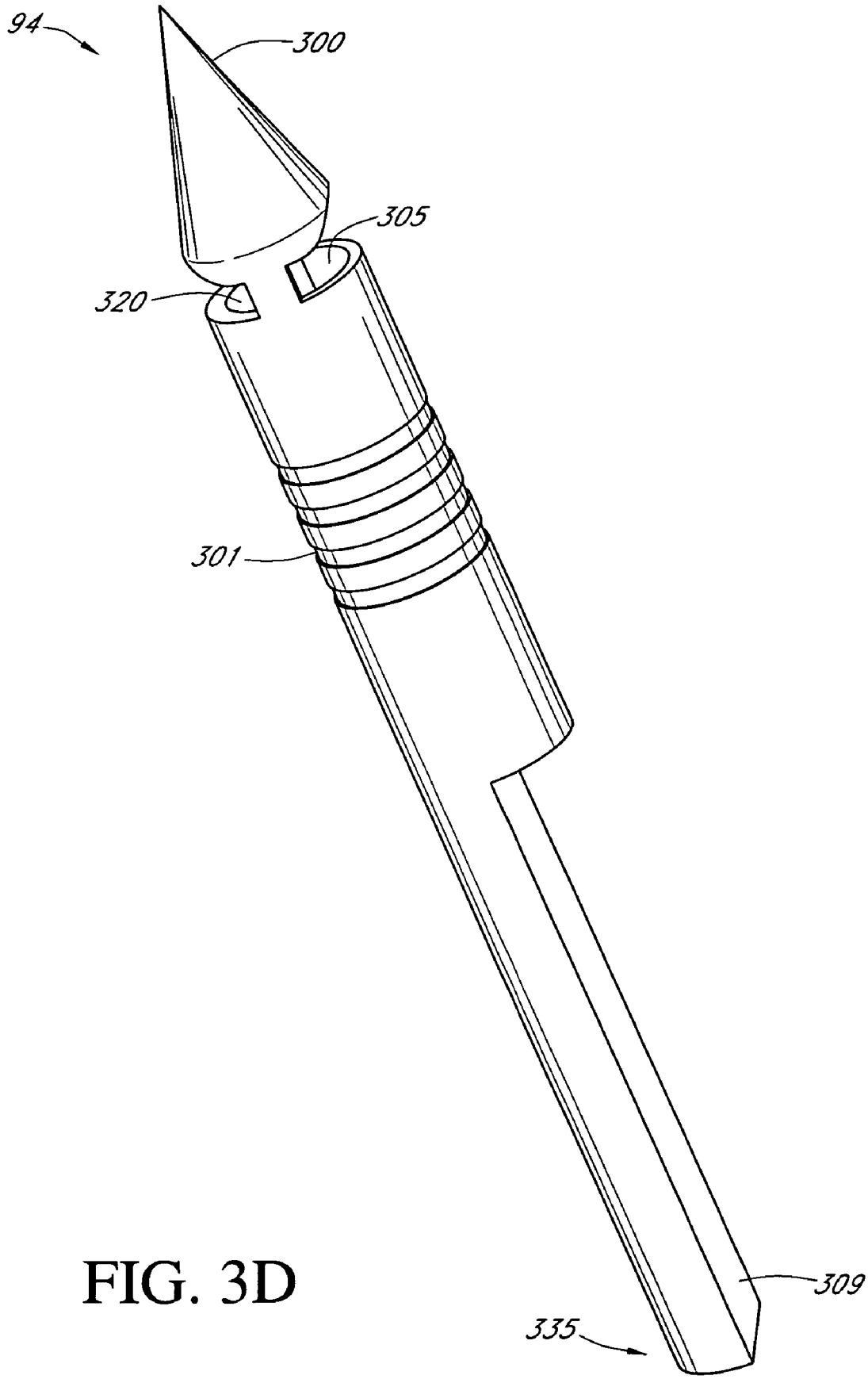
Figure 3E:
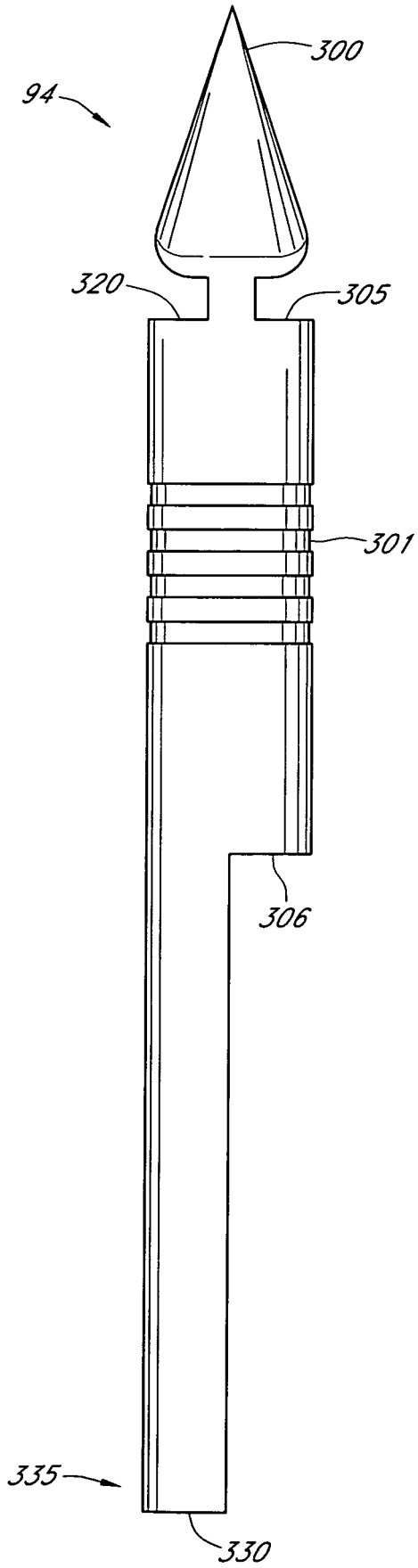

FIGS. 3C to 3E show various perspective views of another embodiment of the needle 94. The embodiment shown in FIGS. 3C to 3E could be molded rather than machined as in the embodiment of FIGS. 3A and 3B. The needle 94 in this embodiment includes a sharp tip 300 that is adapted to pierce the septum cap of an ink refill bottle. Below the tip 300 is an air access opening 305 that exhausts air into the ink refill bottle from an air inlet opening 306, which is open to the air pocket inside of the reservoir 89. This air flow into the ink refill bottle replaces the volume of ink which flows out of the ink refill bottle and into the reservoir 89, through a channel on the opposite side of the needle 94. Below the air access opening 305 is a series of external features 301 located where a lower wall of the reservoir opening 90 is bonded to the needle 94.

The needle 94 of FIGS. 3C to 3E comprises an air pasageway connecting the air access opening 305 and the air inlet opening 306. There is also a longer ink passageway connecting the ink inlet 320 and the ink outlet 330. In the example shown, the ink and air passageways are divided by a narrow rib 309. In other embodiments, multiple air and/or ink passageways may be formed in the needle 94.

The air and ink passageways of the examples shown in FIG. 3 have a semicircular cross section within a substantially circular needle body. However, other shapes may be used for the needle body and/or passageways (e.g., triangular, square, rectangular, etc.).

Of course it should be noted that embodiments of the reservoir of FIG. 2 and the needle of FIG. 3 are not limited to being used for ink. In some embodiments, the bottle can contain any type of fluid and the reservoir can communicate the fluid to any type of fluid dispenser. For example, the bottle may contain a soft drink concentrate and the reservoir may communicate the concentrate to a soft drink dispenser.

Figure 4B:
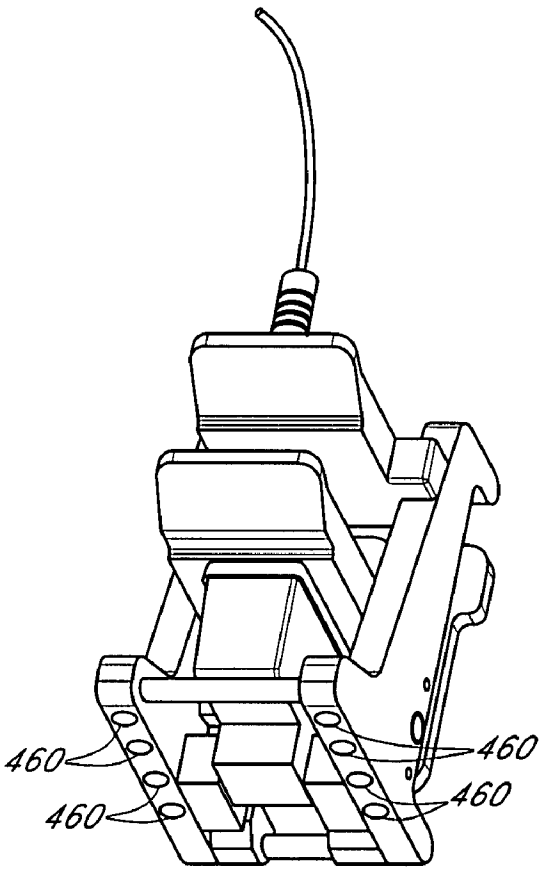
FIGS. 4A to 4C are perspective views of an embodiment of an inkjet fixture for receiving inkjet cartridges.
Figure 4A:
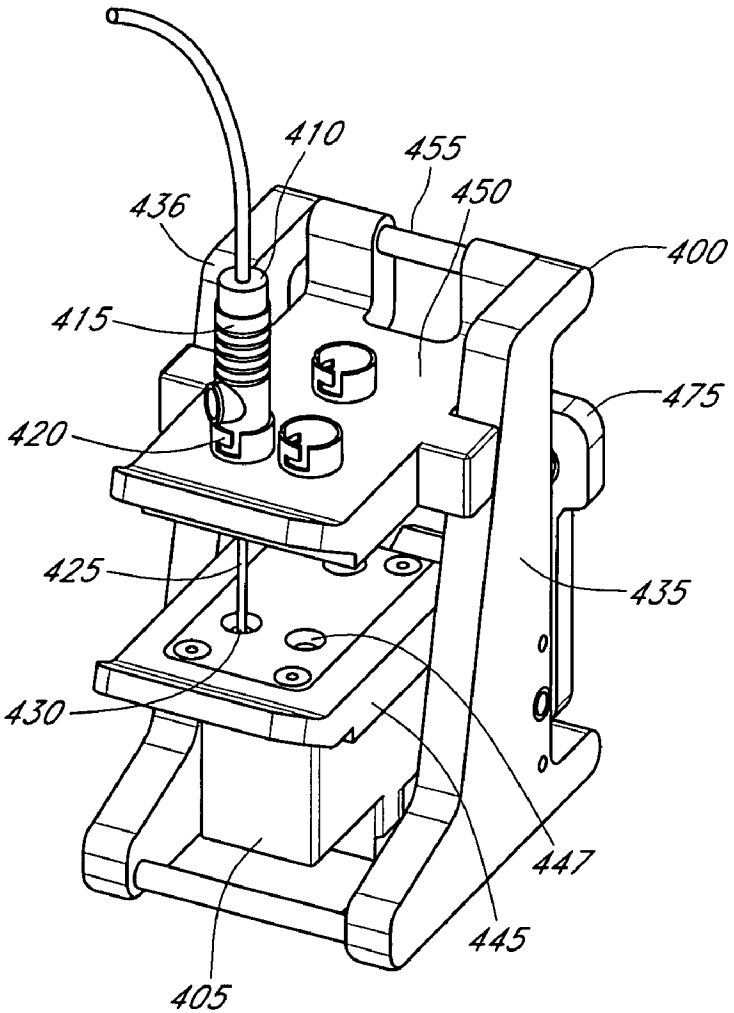
Figure 4C:
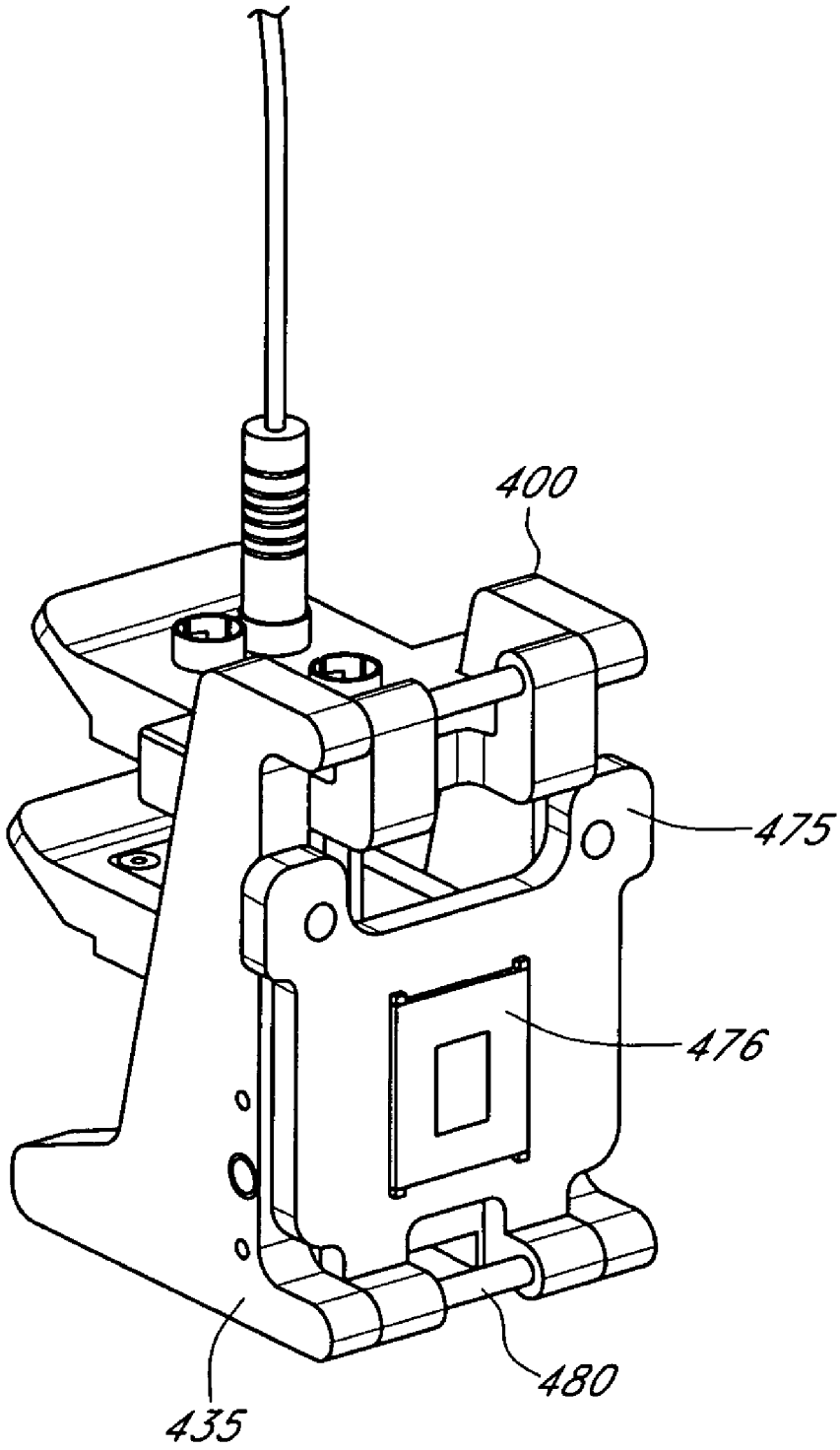

Referring now to FIGS. 4A-4C, a series of perspective views of a fixture 400 mated to a cartridge 405 are shown. In this embodiment, an ink refill needle 410 is positioned within the fixture 400 and having a head portion 415 latched into a locking mount 420. As can be imagined, each needle can be provided with a unique latch type or size so that it only will mate with one particular locking mount 420 within the fixture 400. In this manner, the operator would not be able to place the wrong needle into the wrong mount, which would lead to an incorrect ink type or color being introduced into a chamber of the cartridge 405. As is known, many cartridges have several chambers, with each chamber having a different type or color of ink. As shown, a needle tip 425 protrudes from the head portion 415 and through an orifice (not shown) that was drilled into the cartridge 405.

The fixture 400 has a pair of side supports 435, 436 which are connected by a back surface (not shown). Attached to the back surface is a spring and set of mating features (not shown) that are configured to lock the cartridge 405 into place. A movable lower surface 445 is hinged and can thereby move up and down to alternately lock the cartridge 405 into place in the fixture 400.

The movable lower surface 445 also includes a series of openings 430, 447 that are aligned with the various chambers of the cartridge 405. It should be realized that each particular fixture 400 is configured to mate with a particular cartridge 405. Accordingly, the movable lower surface 445 of each fixture 400 is designed to provide holes at predetermined positions adjacent the top of the cartridge 405. Thus, when each type of fixture is placed within the drilling station, the operator will drill holes into the cartridge at predetermined positions that will not damage the cartridge and will provide accurate access to the separate chambers within the cartridge.

Also shown in FIGS. 4A and 4B is a movable upper surface 450 which is connected to the side support surfaces 435, 436 through a traversing bar 455. The upper movable surface 450 connects to the traversing bar 455 so that it can swing freely around the bar and thereby be able to flip from its shown position parallel to the lower movable surface 445 to a position at the back of the fixture 400. The upper movable surface 450 can be rotated to the back of the fixture 400 during drilling and other operations that do not require the needles to be used. When it is time to insert the needles into the fixture 400, the upper movable surface can be flipped back over parallel to the lower movable surface 445 and the needle can be positioned within the locking mounts.

Also shown in FIGS. 4A and 4C is a movable bottom surface 475 which is connected to the side support surfaces 435, 436 through a traversing bar 480. The movable bottom surface 475 connects to the traversing bar 480 so that it can swing freely around the bar and thereby be able to flip from its shown position at the back of the fixture 400 to a position parallel to the lower movable surface 445 and contacting the cartridge 405. Attached to the movable bottom surface 475 is a compliant seal surface 476 which seals around the nozzles of the printhead of the cartridge 405 when the movable bottom surface 475 is rotated into position against the cartridge. During filling and other operations that do not require the compliant seal surface 476 to be used, the movable bottom surface 475 can be rotated to the back of the fixture 400, which allows the cartridge printhead to be exposed to the various stations of the system 10.

In one embodiment, each of the different fixtures contains a unique code that is recognized by the system 10 (FIG. 1) so that it can properly fill the cartridge that is being held within the fixture. As shown in FIG. 4B, a plurality of magnets 460 can be placed in the bottom of the fixture 400. The system 10 can then be provided with magnetic sensors which determine which of the magnets 460 are present on a particular fixture. By determining the positions of the magnets on a particular fixture, the system can determine the fixture type, and therefore the cartridge type that is being refilled. As shown, in this embodiment, eight magnetic positions are shown. Thus, each fixture could provide a unique set of magnets within these eight locations.

Of course, it should be realized that embodiments of the invention are not limited to only magnetic coding of fixtures. Any type of coding which allows the system to uniquely recognize each type of fixture is contemplated. For example, the system may use a bar code, magnetic field identifier (MFID), or a radio frequency identifier (RFID) on each fixture and then determine the type of fixture from that information.

Figure 5:
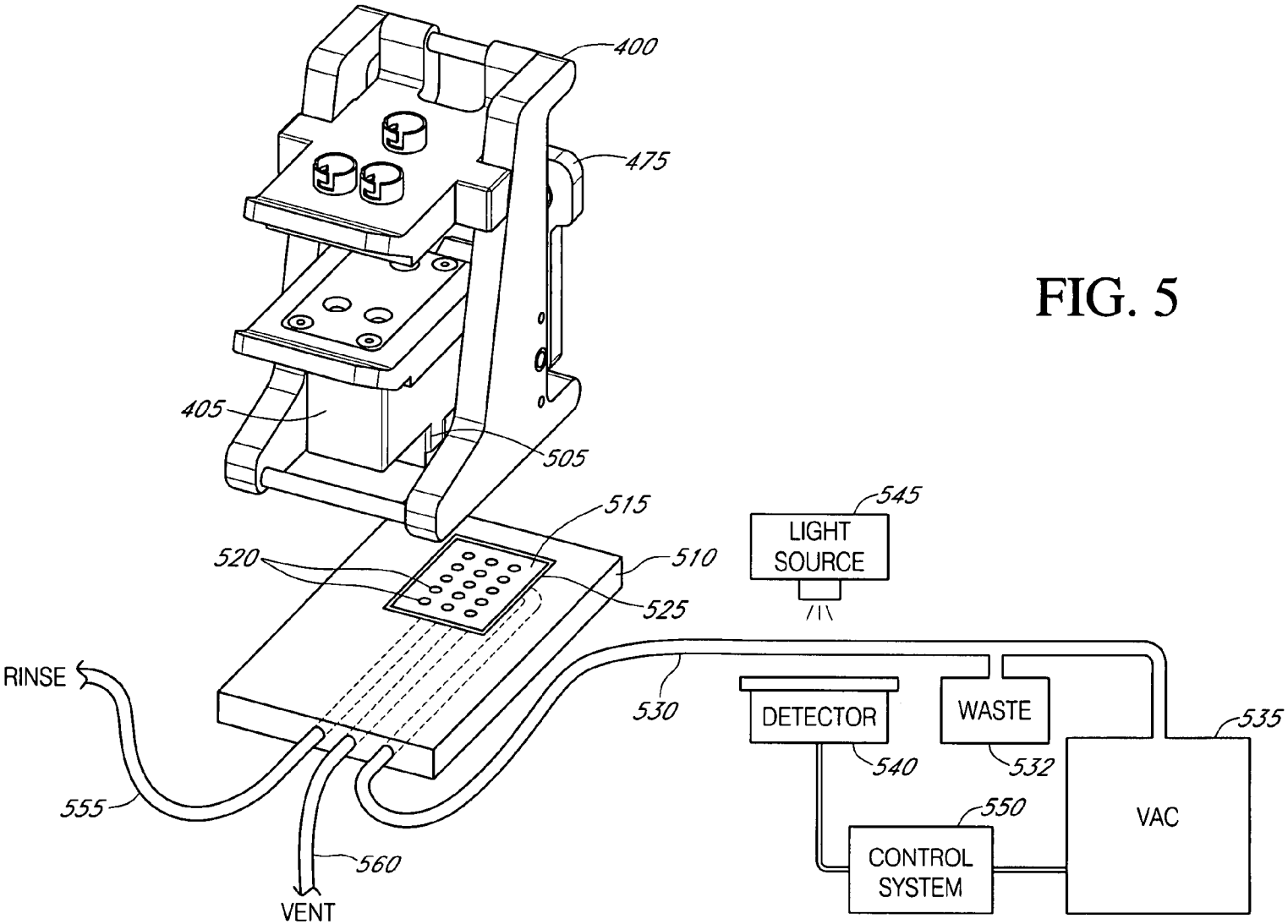
FIG. 5 is a combination functional block diagram and perspective view of an embodiment of a cleaning station of the system of FIG. 1 for cleaning an inkjet cartridge in the inkjet fixture of FIG. 4.

FIG. 5 shows a functional block diagram of one embodiment of the evacuation station portion of the mounting station 45 (see FIG. 1) which is used to empty the ink from a cartridge. As shown, the fixture 400 includes the movable bottom surface 475 and the inkjet cartridge 405. The cartridge has a downward pointing head 505 which comprises the ink nozzles of the printhead (not shown). A lower portion 510 of the evacuation station includes a plate 515 which is positioned below the head 505 when the fixture 400 is within the evacuation station. Within the plate 515 are a series of orifices 520 circumscribed by a flexible seal 525. When the movable bottom surface 475 is rotated into place below the cartridge 405, the compliant seal surface 476 seals against the head of the cartridge 505 and around the nozzles of the printhead. When the fixture 400 is mounted into the mounting station 45, the bottom of the fixture 400 contacts and seals against the flexible seal 525. In this way, the orifices 520 are sealed to the cartridge fixture 400, which is in turn sealed to the head of the cartridge 505, allowing the orifices 520 to fluidly communicate with the printhead of the cartridge. The flexible seal 525 and/or the compliant seal surface 476 can be configured to fluidly seal where, fluidly seal can mean to prevent air or liquid or both from leaking past the sealed area.

A vacuum line 530 connects the plate 515 to a waste container 532 and a vacuum source 535 thereby providing one means by which a vacuum can be created at the head 505. Creating such a vacuum draws any ink within the cartridge 405 into the waste container 532 for disposal or recycling.

In one embodiment of the invention, the vacuum line 530 is transparent, or semi-transparent, and a detector 540 detects whether or not ink is running through the vacuum line 530. For example, a light source 545 can shine a light through one side of the vacuum line 530 and the detector 540 is positioned to detect whether the light is detectable on the opposite side of the vacuum tube 530. In this embodiment, the detector is linked to a vacuum control system 550. Thus, when ink is traversing the vacuum line 530 some light from the light source 545 will be blocked from reaching the detector 540. During this time, the control system will maintain vacuum so that the remaining ink can be extracted from the cartridge 405. In one embodiment the detector is model FSV-21R detector commercially available from Keyence Corp. (Yodogawa, Osaka, Japan)

As ink is removed from the cartridge 405, the vacuum line will eventually appear clear and the detector 540 will send a signal to the control system 550 to shut off the vacuum. In one embodiment, the detector 540 is configured to send a signal to the control system 550 to shut off the vacuum after a predetermined amount of ink is removed from the cartridge 405. The predetermined amount of ink to be removed before signaling the control system 550 to shut off the vacuum can be in a range from about 50 percent to about 100 percent of the capacity of the cartridge 405, preferably from about 70 percent to about 90 percent or 95 percent of the capacity of the cartridge 405. This feedback mechanism allows the evacuation system to remove ink from a plurality of cartridges, each having a variable volume of ink remaining within them at the time of refilling Since the system detects when the last of the ink has been removed from the cartridge, it will only draw a vacuum for the proper amount of time necessary to remove the remaining ink from the cartridge.

It should be realized that embodiments of the invention are not limited to the particular type of detector described above. Any type of detector that determines when ink is flowing within the vacuum line 530 is contemplated within the scope of the invention. For example, conductivity sensors and flow detectors are also within the scope contemplated by the invention.

In an additional embodiment, the plate 515 is also connected to a rinse line 555 which provides a rinse solution to the head 505 of the cartridge 405. During the process of removing ink from a used cartridge, it may be desirable to rinse the interior chambers of the cartridge with water or a cleansing solution. The rinse line 555 is connected to a source of pressure (not shown) in one embodiment so that the rinse solution can be pressure fed through the nozzles of the cartridge and into the interior cartridge chambers.

The plate 515 is also connected to a vent line 560 which can be activated to relieve the vacuum applied to the head 505. Thus, in one embodiment of using the system, the control system would draw a vacuum and remove any remaining ink from the cartridge. A wash solution could then be introduced into the cartridge through the nozzles. It should be realized that multiple steps of rinsing and evacuating may be manually or automatically performed by the system in order to prepare a cartridge for refilling. Once the cartridge is ready for refilling, the vent line 560 can be opened to the ambient environment to break any vacuum that is retaining the cartridge 405 against the plate 515.

In an additional embodiment, a pressure sensor can be connected to the vent line 560 or rinse line 555 such that it will measure the vacuum applied to the cartridge when the vacuum is applied to the head 505. Because the sensor is connected to a non-vacuum orifice, it may only read the full vacuum applied when a proper seal is made between the head of the cartridge 505 and the compliant surface seal 476 as well as between the bottom of the fixture 400 and the flexible seal 525.

In another embodiment, not shown, a centrifuge known in the art can be used to remove ink and/or cleaning solution from the inkjet cartridge during evacuation and/or cleaning cycles. A centrifuge configured to spin the inkjet cartridge such that the liquid exits the cartridge out the nozzles, thereby cleaning and/or evacuating dry sediment from the nozzles.

Figure 6A:
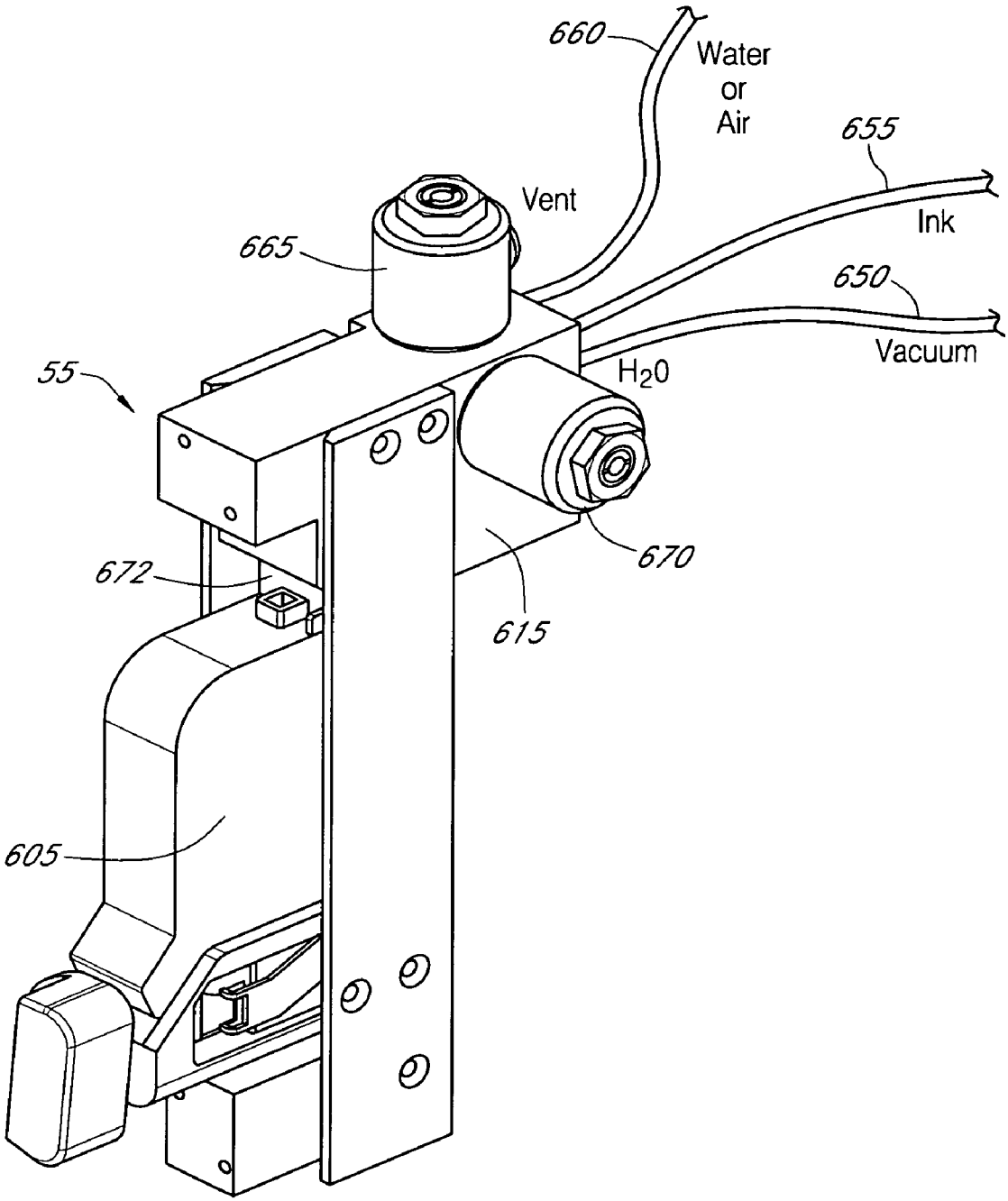
FIG. 6A is an embodiment of a nozzle filling station of the inkjet refilling system of FIG. 1.
Figure 6B:
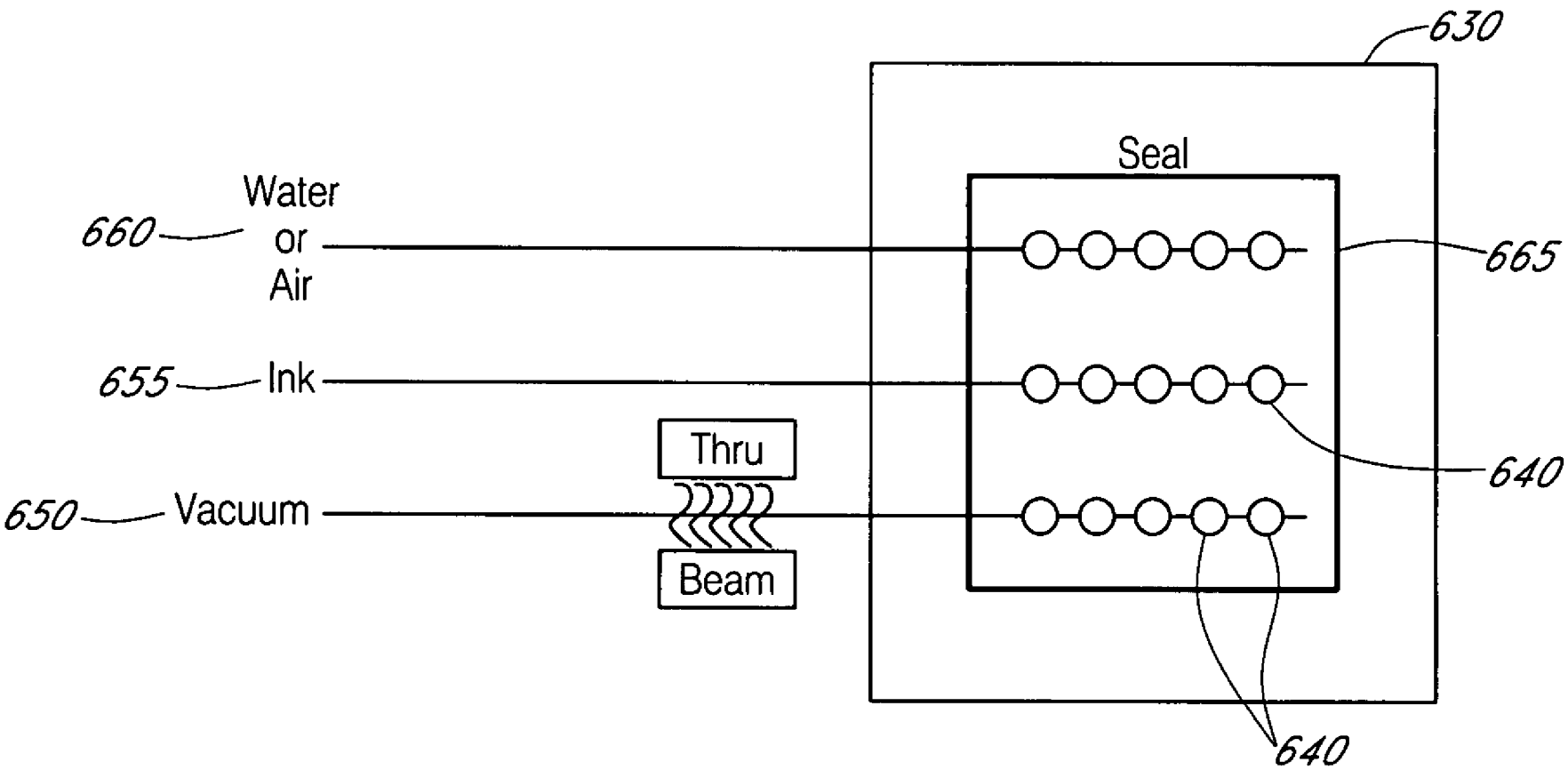
FIG. 6B is an embodiment of a combination inkjet nozzle cleaning, evacuation, and cleaning plate for use with the nozzle refilling station of FIG. 6A.

FIG. 6A shows one embodiment of the nozzle filling station 55 (FIG. 1). As shown, a cartridge 605 that can be filled through its nozzles is placed directly into the nozzle filling station 55 and locked into position. In the illustrated embodiment, the nozzles are pointing in the upward direction, and locked into a housing 615. The nozzle filling station 55 includes a nozzle filling plate 630 (FIG. 6B) that communicates with a vacuum source 650, an ink source 655 and a vent/rinse source 660. An electronically controllable valve 665 controls access to the vent/rinse source 660 while a second valve 670 controls access to the vacuum source 650. More details of the filling plate 630 are shown in FIG. 6B. The filling plate 630 comprises a plurality of orifices 640 for connecting the cartridge 605 with the sources 650, 655 and 660. A gasket 665 circumscribes the plate 630 and provides a means for creating a tight seal between the plate 630 and the head of the cartridge 605. The gasket 665 and can be configured to fluidly seal where, fluidly seal can mean to prevent air or liquid or both from leaking past the gasket.

As can be appreciated, in use, an operator locks the cartridge into position in the nozzle filling station 55 which places a head 672 of the cartridge 605 in contact with the plate 630 so that it seals against the gasket 665. The system 10 then begins a cycle to refill the cartridge through the nozzles. In a first step, the vacuum source 650 is activated to create a vacuum within the cartridge. This draws any remaining ink from the cartridge so that the system can determine the proper amount of ink to use in refilling the cartridge. If an unknown amount of ink remained within the cartridge, the system may overfill it and cause a malfunction. In one embodiment, the vacuum line 650 includes an ink sensor as described above for determining when ink is within the vacuum line 650. In an additional embodiment, a pressure sensor can be connected to the vent/rinse source 660 such that it will measure the vacuum applied to the cartridge by the vacuum source 650. Because the sensor is connected to a non-vacuum orifice, it will only read the full vacuum applied when a proper seal is made between the head of the cartridge 605 and the gasket 665.

Once all of the ink has been removed from the cartridge 605, the system 10 then activates the proper ink pump which forces ink into the cartridge by way of the ink source 655. The ink is forced from the ink source 655, through the orifices 640, and into the nozzles of the cartridge 605. When the ink fill is complete, the system 10 activates the vent/rinse line 660 along with the vacuum line 650 in order to clean the surface of the cartridge 605 and release the vacuum prior to removal.

Figure 7:
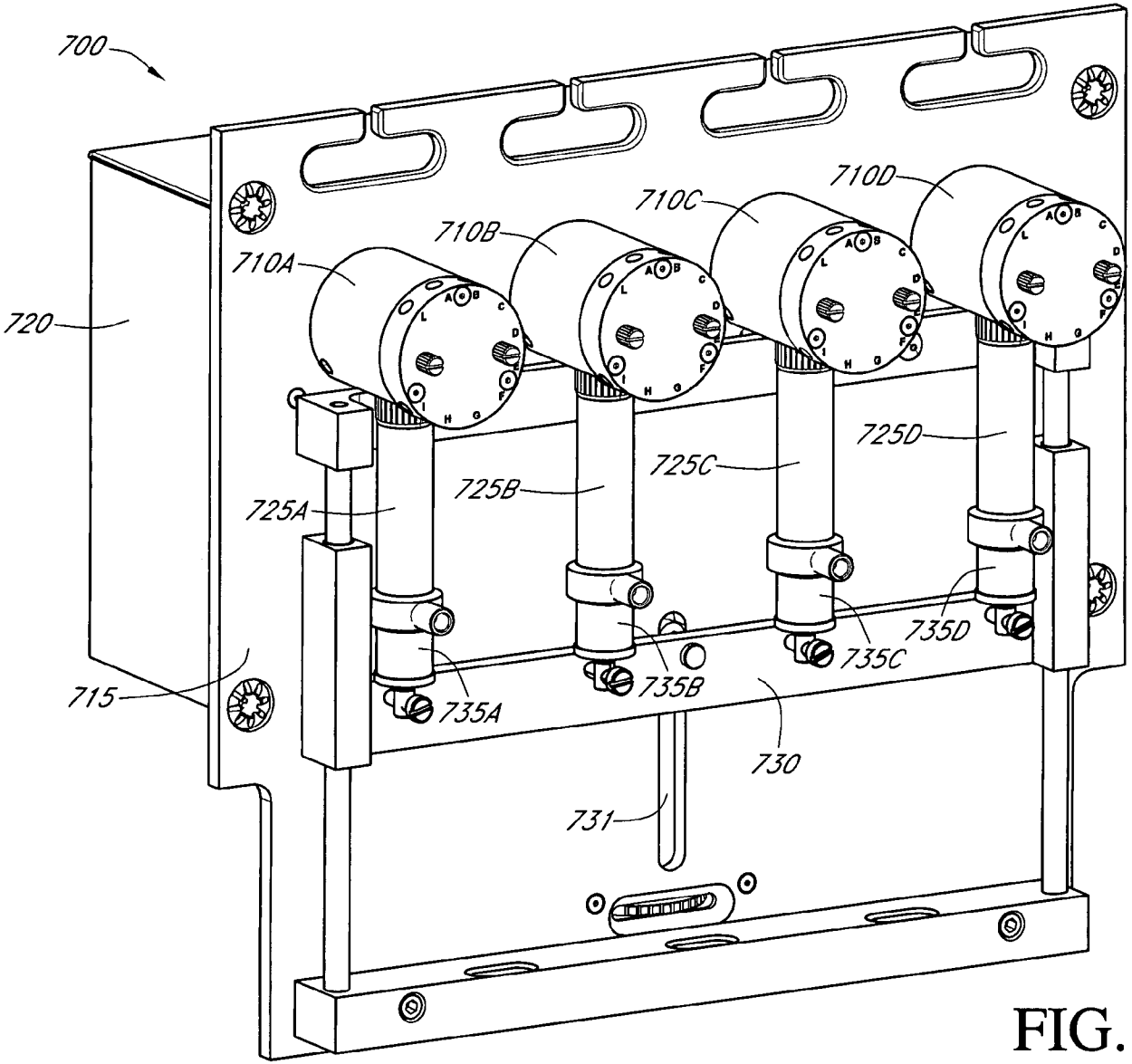
FIG. 7 shows an embodiment of an ink pumping system for use in the inkjet refilling system of FIG. 1.

FIG. 7 shows one embodiment of an ink pumping system 700 which is designed to allow the system to direct ink from a plurality of ink sources into the correct station on the system 10 shown in FIG. 1. As shown, a series of four rotary valves 710A, B, C, and D are mounted to a vertical wall 715. Opposite the valves 710, on the other side of the wall 715 are a set of matching motors, not shown, within a housing 720. Each matching motor controls one of the rotary valves 710. In one embodiment the rotary valves are commercially available 8-way rotary distribution valves. As can be envisioned, the matching motors are each connected to the computer system that controls the refilling system 10. Each motor can be individually activated in order to rotate each valve to a desired position.

Below each valve is a syringe 725A, B, C, D which is connected to the common port of each valve 710A,B,C,D. A syringe motor (not shown) is located on the opposite side of the wall 715 from the syringes 725 and connects through a vertical opening 731 to a traverse bar 730. The traverse bar 730 is attached to a lower portion 735A,B,C,D of each syringe 725A,B,C,D. The pump motor can be activated by the system 10 to move the traverse bar 730 in a vertical direction, either up or down. When the traverse bar 730 moves downward, it expands the syringes 725 and begins to draw liquids through the valves 710 and into each syringe. When the traverse bar 730 moves upwards, it compresses the syringes 725 and forces the contents of each syringe back through each valve.

Accordingly, the system can, for example, select a particular ink source within the system and then direct the motor corresponding to the valve 725D to move the valve 725D to select a first port for a particular source of ink. In this example, it may be the port connected to a supply of yellow ink. Once the yellow ink port has been selected, the pump motor can be activated to begin slowly drawing yellow ink into the syringe 725D. One the proper amount of yellow ink has been drawn into the syringe 725D, the system can direct the motor to select the proper output port, for example, the needle within the vacuum chamber 60 described above. Once the output port has been selected, the system then instructs the pump motor to begin raising the traverse bar 730 which compresses the syringe 725D, and forces the yellow ink into the selected needle.

In this embodiment, the system can select any port of any rotary valve to provide an input into the syringe pump. In addition, any port can similarly be selected as an output port. In one embodiment, each of the four rotary valves is fluidly connected to a different color used in refilling inkjet cartridges. For example, the rotary valve 710A may be connected to one or more black ink sources, while rotary valve 710B is connected to one or more cyan ink sources in the system. Similarly, the rotary valve 710C may be connected to one or more magenta ink sources, while the rotary valve 710D is connected to one or more yellow ink sources. The fluid connections in one embodiment of the invention are described in more detail with reference to FIG. 8.

It should be realized that embodiments of the invention are not limited to the particular configuration of the rotary valves, syringe pumps and motors. Other configurations are also contemplated. For example, instead of a traverse bar that operates all of the syringes simultaneously, individual motors could be provided to each syringe to individually control them.

Figure 8:
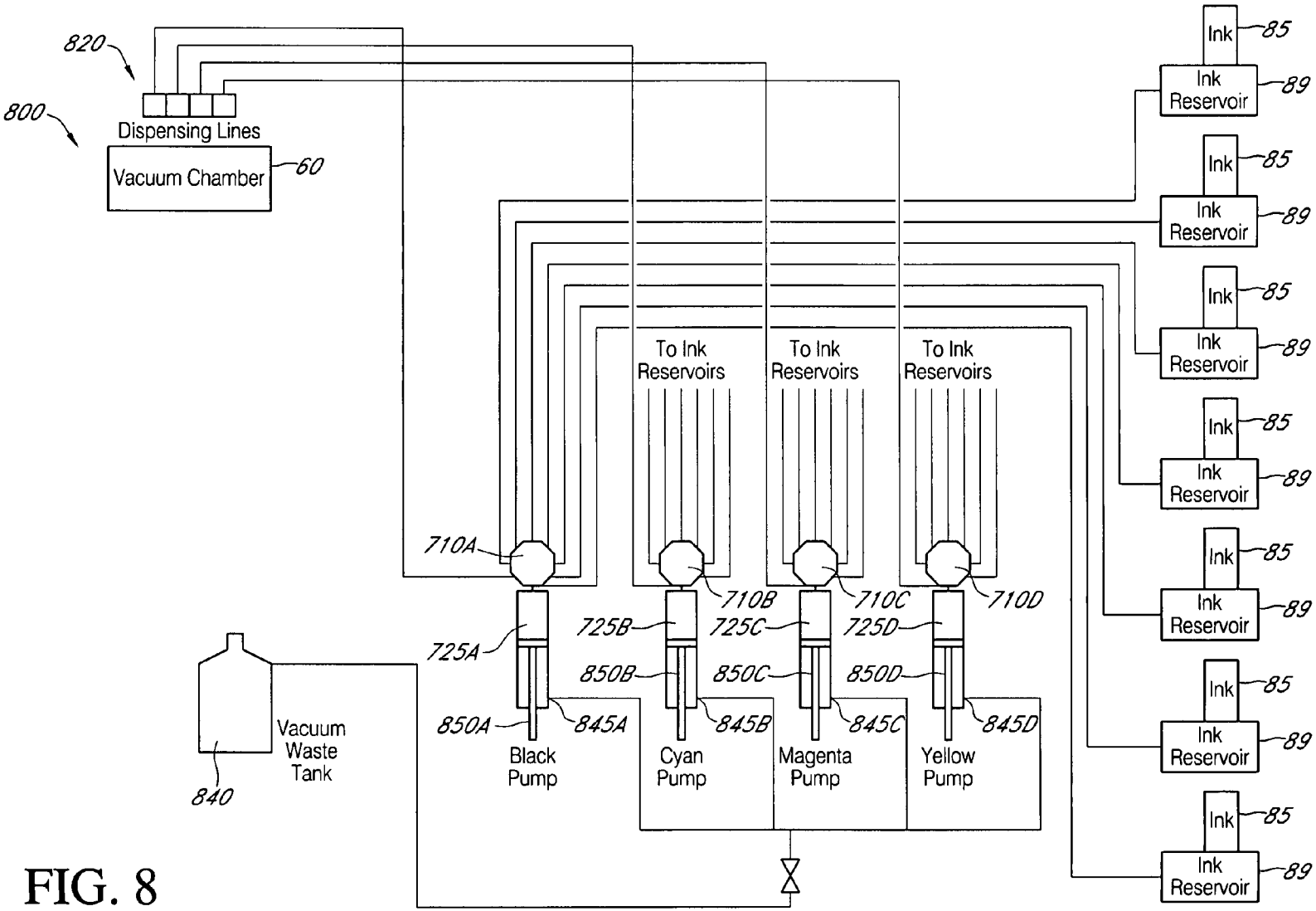
FIG. 8 is a diagram of an embodiment of a fluidics system for use in the inkjet refilling system of FIG. 1.

FIG. 8 is a diagram of the fluidics system 800 within the system 10. As shown, each of the bottles 85 and their associated ink reservoirs 89 communicate with one of the rotary valves 710. In this embodiment, each rotary valve controls a particular color of ink. For example, the rotary valve 710A is connected to the ink bottles containing black ink, whereas the rotary valve 710B connects to cyan ink bottles, rotary valve 710C connects to magenta ink bottles and rotary valve 710D connects to yellow ink bottles.

Communicating with each rotary valve 710 is an associated syringe 725A, B, C and D which is configured to draw ink through the valve on the way down, and force ink back through the valve as it moves back to it upper position. As shown, each of the valves 710 connects to dispensing lines or tubes 820 which are within the vacuum chamber 60. Each dispensing line typically terminates in a needle that is used to refill the cartridge housed in the vacuum chamber.

In addition to the ink connections to the rotary valves 710, each valve 710 also communicates with a wash source that can be used to rinse out each syringe 725 as well as a waste port for disposing of unwanted fluids. As shown, a vacuum waste tank 840 also connects to each syringe in a remote position 845A, B, C, D, or backflush port, which is at a lower portion of each syringe 725. By lowering a plunger 850A, B, C, or D to its lowest position, the system can open each syringe 725 to communicate with the vacuum source 840. Thus, for example, during a wash cycle the system may fill each syringe 725 with a wash solution, and thereafter lower the plunger 850 below the its remote position 845 so that the vacuum source 840 can remove the wash solution from the syringe valve. However, it should be realized that during typical operations, the plunger 850 remains above the remote position 845 thus preventing any ink within the syringe 725 from being removed by the vacuum source 840.

Referring to FIG. 9, an exploded view of the vacuum chamber 60 and its associated concave door 62 is shown. The concave door 62 includes a rectangular recessed surface 905 that protrudes into the chamber 60 when the door is closed. An outcropping 910 is positioned within the recessed surface 905 and provides a cavity for the dispensing lines 820 when the door 62 is closed.

In one embodiment of the invention, the concave door 62 reduces the volume of the vacuum chamber by between about 10% and 90%. In another embodiment, the concave door reduces the volume of the chamber by between about 20% and 70%. In another embodiment of the invention, the concave door reduces the volume of the chamber by about 50%. However, although the embodiment of the concave door 62 is shown as having a rectangular recessed surface 905, the invention is not limited to any particular shaped door. Other doors that reduce the volume of a vacuum chamber are also contemplated. In addition, it may be possible to provide a door that does not include the outcropping 910 and instead places the cartridge 405 further back within the chamber so that the dispensing lines do not impede the door 62 from closing.

Figure 10:
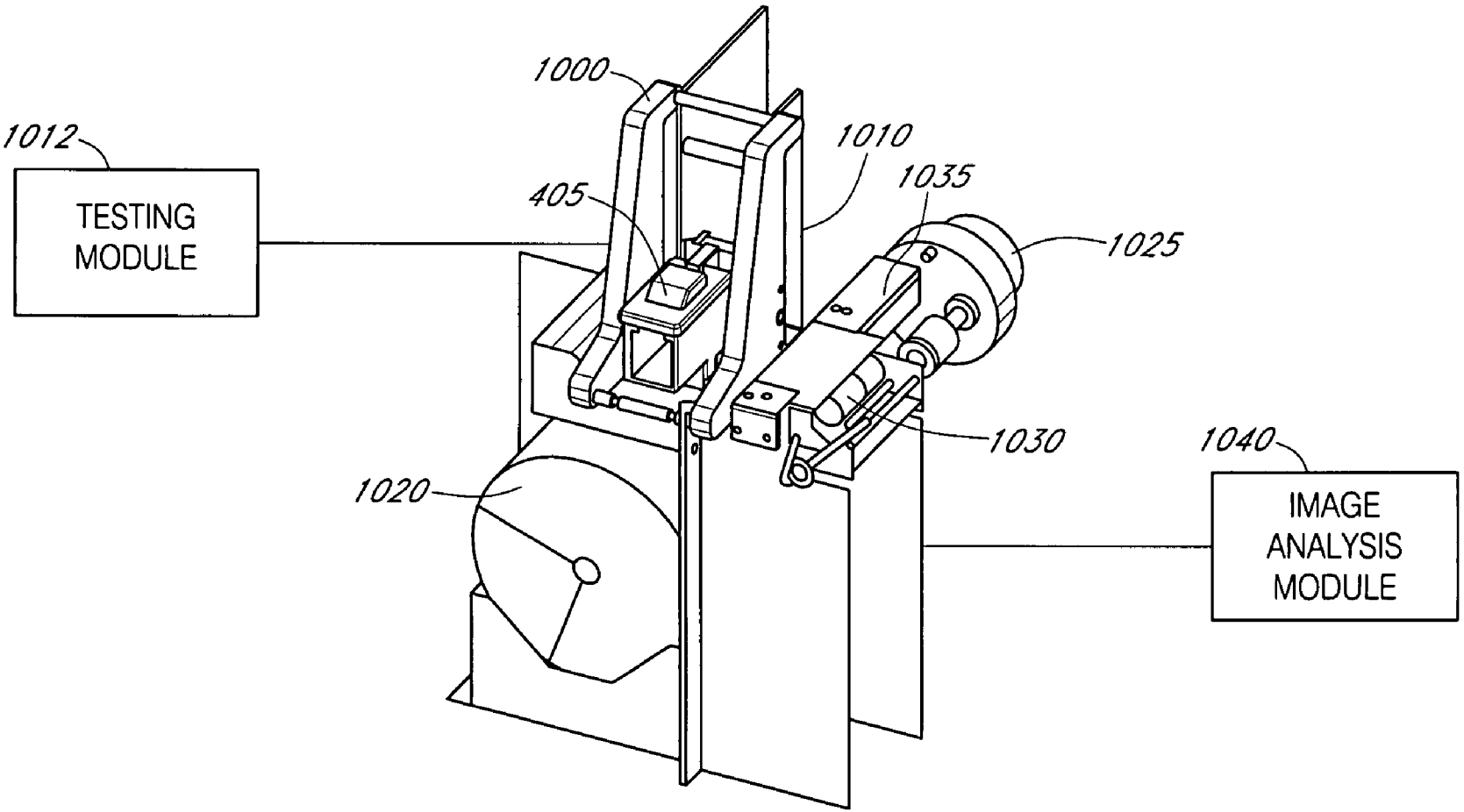
FIG. 10 is an embodiment of a test station of the inkjet refilling system of FIG. 1.

FIG. 10 shows one embodiment of the test station 75 of the inkjet refilling system 10 of FIG. 1. As shown, the cartridge 405 is mounted within mounting means such as a test fixture or adapter 1000 which is in a receiver 1010 of the test station 75. Below the fixture 1000 is a spool of paper 1020 that feeds a strip of paper under the nozzles of the cartridge 405. A motor 1025 linked to a set of rollers 1030 moves the paper beneath the cartridge during a test. In addition, an optical scanner 1035 is placed above the strip of paper and captures images of the paper as it is moved past the cartridge 405.

The receiver 1010, in this embodiment, serves as connecting means and is electrically connected to a testing module 1012 within the system 10 that controls the test and can take electrical measurements of the cartridge 405 and instruct the nozzles to fire or eject ink drops in a predetermined pattern. The testing module 1012 contains highly flexible circuitry and instructions that allow for a wide variety of cartridge types to be tested. The scanner 1035 is linked to an image analysis test module 1040 within the system 10. The analysis module 1040 captures the images created on the paper strip by the cartridge 405 and uses that data to determine if each nozzle on the cartridge is firing properly. In some embodiments, the image analysis module is linked to the testing module 1012 so that the testing module 1012 may run a particular test, and the image analysis module may then receive data informing it of the test that was run. After knowing which test was run, the image analysis module can properly determine if the nozzles are working. Methods for testing cartridges using the test station 75 are discussed below in reference to FIG. 15.

Figure 11B:
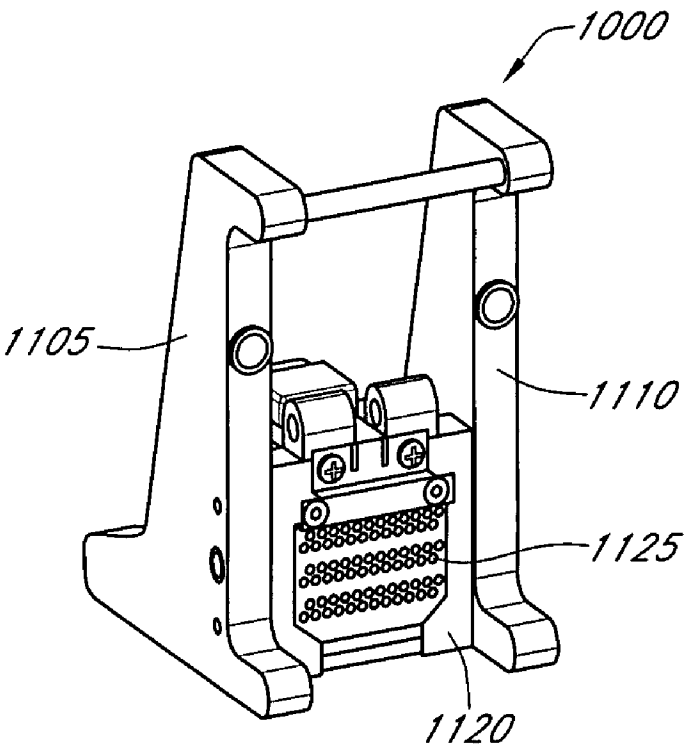
FIGS. 11A and 11B are perspective views of an embodiment of a test fixture for use in the inkjet refilling system of FIG. 1.
Figure 11A:
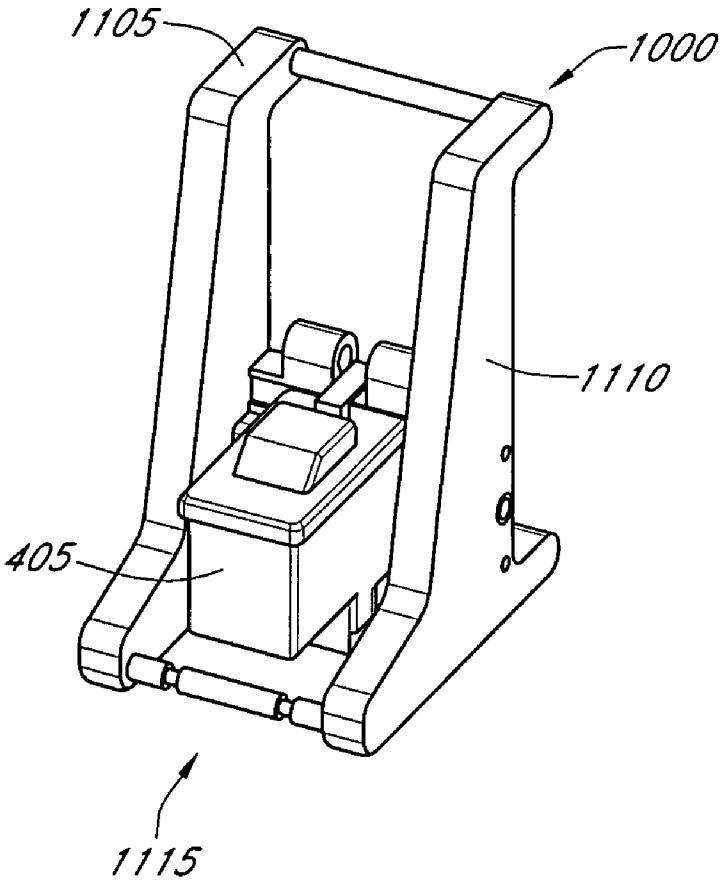

FIGS. 11A and 11B provide a perspective view of the test fixture 1000 described above. As shown, the fixture 11000 comprises two side supports 1105, 1110 connected by a rear surface 1120. The bottom of the test fixture is open so that the nozzles of the cartridge 405 are exposed below the fixture for printing. A rear surface 1120 includes two sets of contacts for connecting the cartridge to the system. An interior portion (not shown) of the rear surface 1120 provides an electrical interface configured to mate with the electrical interface of the cartridge 405. The exterior portion of the rear surface 1120 provides an electrical interface configured to mate with a set of contacts in the test receiver 1010. Thus, when the cartridge 405 is placed into the test fixture 1000, the electrical interface of the cartridge makes an electrical connection with the contacts on the interior portion of the rear surface 1120. Similarly, when the fixture 1000 is mounted into the receiver 1010, the contacts 1125 make an electrical connection with contacts in the receiver 1010 and thereby provide a means for electrically connecting the cartridge 405 to the system 10.

In some embodiments, each of a plurality of different fixtures 1000 configured to mate with a specific configuration of inkjet cartridge contains a unique identifier code that is recognized by the test system so that it can properly control the print nozzles of the cartridge that is being held within the fixture. The unique identifier can be similar to the fixture 400 of FIG. 4B, where a plurality of magnets 460 can be placed in the bottom of the fixture 1000. Of course, it should be realized that embodiments of the invention are not limited to only magnetic coding of fixtures. Any type of coding which allows the system to uniquely recognize each type of fixture is contemplated. For example, the system may use a bar code, magnetic field identifier (MFID), or a radio frequency identifier (RFID) on each fixture and then determine the type of fixture from that information. In one embodiment, the unique identifier comprises a portion of the contacts 1125 on the rear surface 1120 of the fixture 1000 being electrically shorted. Each fixture can have a unique pattern of electrically shorted contacts.

Figure 12C:
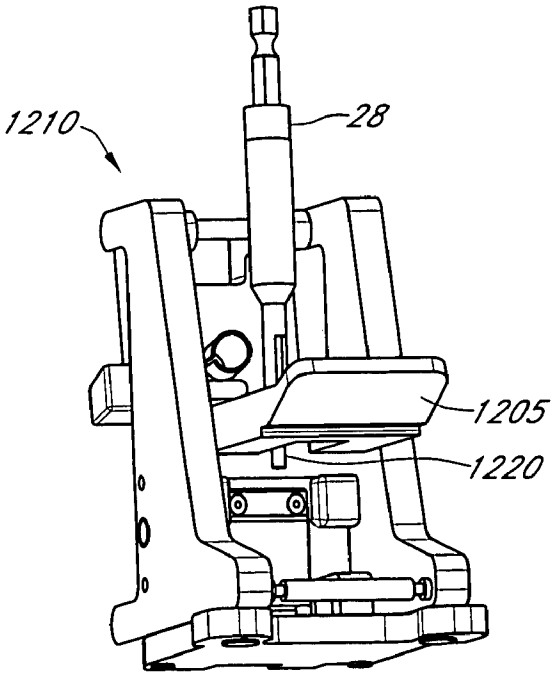
FIGS. 12A to 12C are perspective views of an embodiment of a drill bit and the inkjet cartridge fixture of FIG. 4.
Figure 12B:
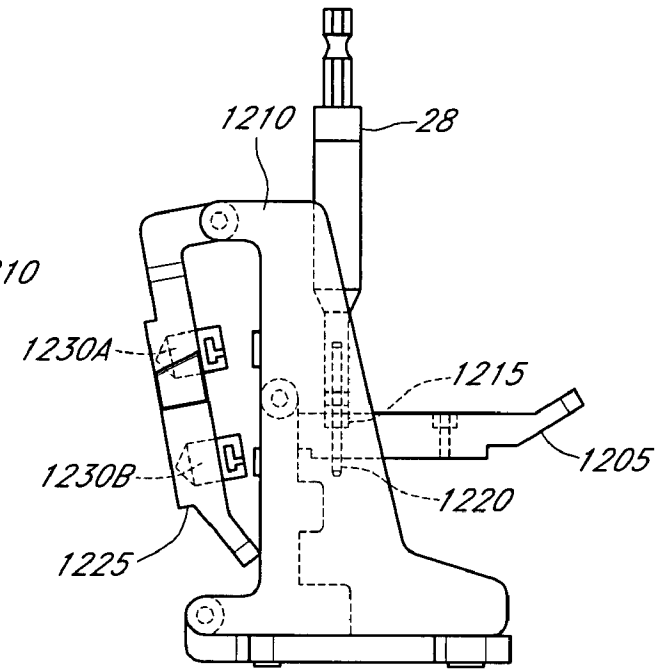
Figure 12A:
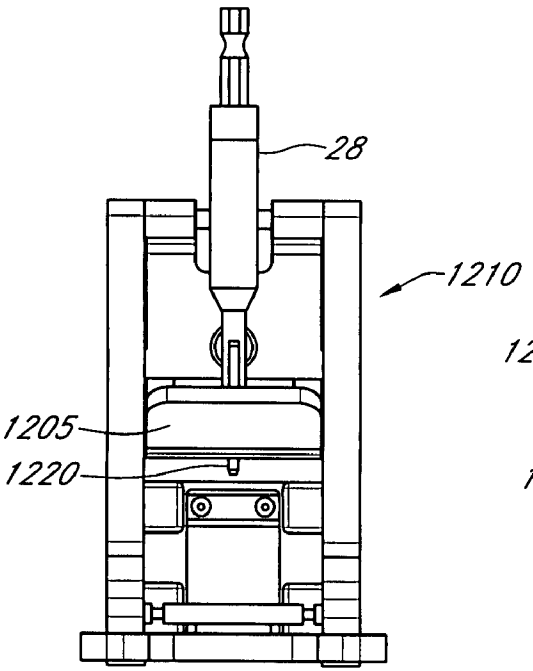

FIGS. 12A, 12B and 12C provide perspective views of the drill station 15 of FIG. 1 including the drill bit 28 protruding through a first movable upper surface 1205 of a fixture 1210. The first movable upper surface 1205 has an alignment pocket 1215, or a series of multiple alignment pockets which locate the proper position (or positions) for the drill holes. As shown, when the drill bit 28 is lowered against the inside of the alignment pocket 1215, a tip 1220 of the drill bit 28 extends out and passes through the alignment hole and could enter a cartridge (not shown). Together, the vertical position of the inside of the alignment pocket 1215 and the inherent extension depth of the drill tip 1220 out of the drill bit 28 allows for the depth at which the drill tip 1220 penetrates the cartridge to be controlled.

A second movable upper surface 1225 is shown flipped over the rear surface of the fixture 1210 so that it is moved out of the way of the drill bit 28. As can be imagined, the second movable upper surface 1225 can be flipped upwards so that it becomes parallel to the first movable upper surface 1205. When the second movable upper surface is in that position, a set of mounts 1230A, and B become positioned directly above the alignment holes in the first upper movable surface 1205.

Figure 13:
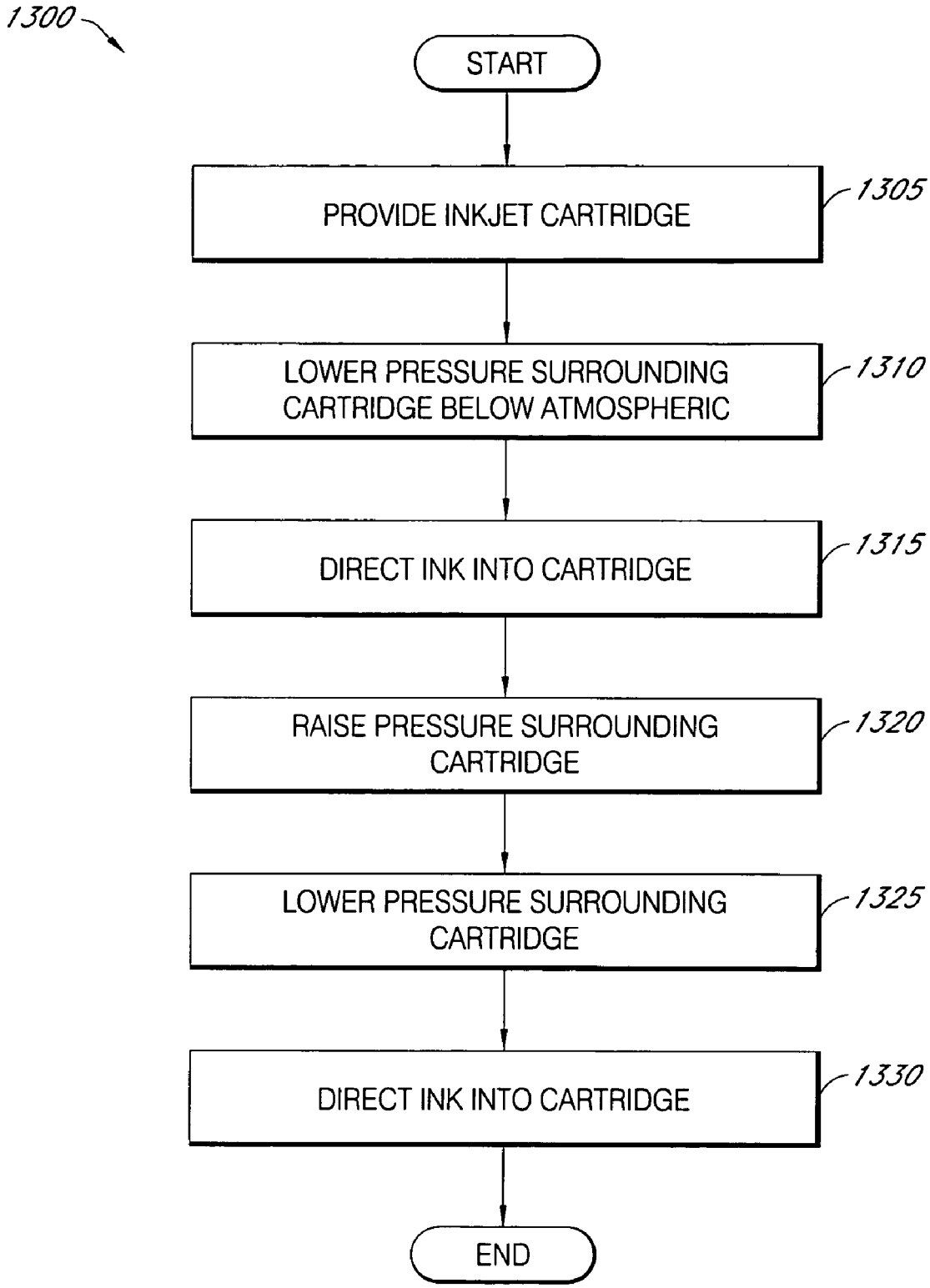
FIG. 13 is a flowchart of an embodiment of a process for refilling inkjet cartridges.

FIG. 13 is a flowchart of an embodiment of a process for refilling inkjet cartridges. The process 1300 can be employed using the refilling station 55 as described above and shown in FIG. 1. In some embodiments, one goal of the fill process 1300 is to maximize the fill volume of the cartridge, but in other embodiments the cartridge may only be partially filled. The process 1300 starts at step 1305 where an inkjet cartridge is provided to the refilling station 55 of the system 10. After the cartridge is provided to the refilling station 55, the process 1300 continues at step 1310 where a vacuum source is employed to lower the pressure around the cartridge to a level lower than the atmospheric pressure. With the surround pressure at a low level, a first portion of ink is directed into the cartridge at step 1315. In one embodiment, the ink is directed through the nozzles of the inkjet cartridge. In another embodiment, the ink is directed through a hole drilled in the cartridge.

After directing the first portion of ink into the cartridge at step 1315, the pressure surrounding the cartridge is raised at step 1320. After raising the pressure surrounding the cartridge at step 1320, the pressure can be lowered again at step 1325. In some embodiments, step 1325 is omitted and a second portion of ink is directed into the cartridge at the higher pressure at step 1330. Embodiments of the invention include cycling the cartridge from, for example, 0.5 atmospheres (atm) to 1 atm, and back again multiple times (repeating steps 1320 through 1330), wherein ink is introduced at each step 1330 following each cycle of steps 1320 and 1320.

In one embodiment, the cartridge is introduced into a vacuum chamber, and the pressure is reduced to 0.1 atm of pressure. The cartridge is filled to one-half of its maximum volume with ink, and then the pressure is released to ambient (1 atm). The system then instructs the vacuum system to reduce the pressure within the vacuum chamber to 0.5 atm, one-quarter of the maximum cartridge volume is introduced into the cartridge, and then the pressure is again released to ambient (1 atm). The system then brings the cartridge down to 0.8 atm of pressure and then introduces the final one-quarter volume into the cartridge.

However, the system is not limited to this one example of cycling the cartridge through a plurality of vacuum steps. Lowering the cartridge to other atm settings, for example, in the range of 0.05 atm to 1.0 atm is contemplated. Variation in the timing of the introduction of the ink, such as during pressure transitions, is also contemplated. In addition, fewer or additional numbers of cycles are contemplated to be within the scope of the invention. It should be noted that certain steps of the process 1300 can be combined, omitted and/or rearranged from the example shown in FIG. 13.

Figure 14:
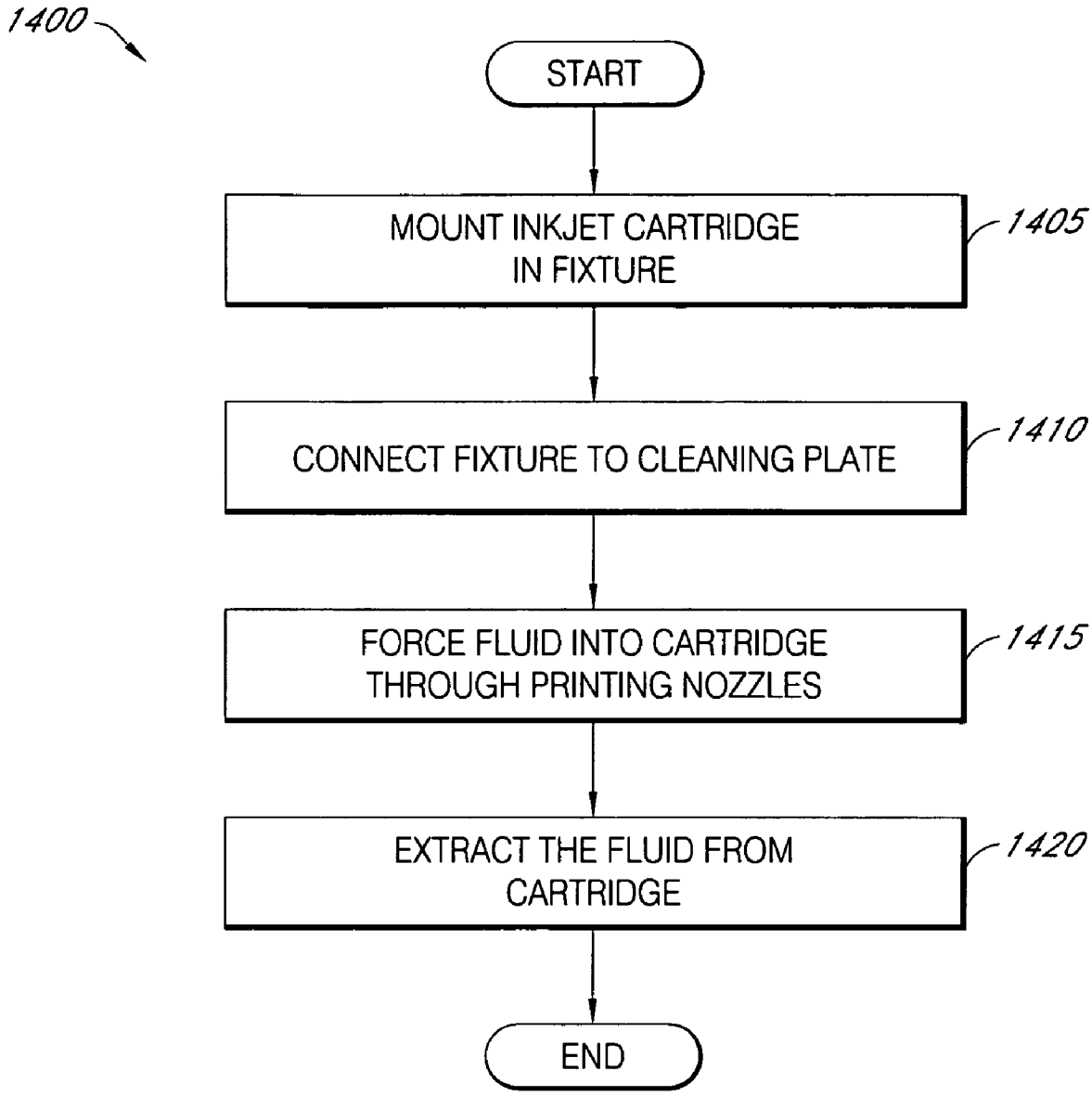
FIG. 14 is a flowchart of an embodiment of a process for cleaning inkjet cartridges.

FIG. 14 is a flowchart of an embodiment of a process for cleaning inkjet cartridges, e.g., using the cleaning station 40 of the system 10 shown in FIG. 1. The process 1400 starts where an inkjet cartridge is mounted in a receiving fixture, e.g., the fixture 400 of FIG. 5. The fixture is then connected at step 1410 to a cleaning plate, e.g., the plate 515 of FIG. 5. A portion of cleaning fluid is directed into the cartridge through the printing nozzles of the cartridge, at step 1415. A pressure source can be used to force the cleaning fluid in to the cartridge at step 1415. The cleaning fluid is then extracted at step 1420. In some embodiments, a vacuum source is used to extract the cleaning fluid. In other embodiments, a centrifuge is used to extract the cleaning fluid at step 1420. Steps 1415 and 1420 can be repeated multiple times if more cleaning is desired. The process 1400 can clean dry ink out of the printing nozzles, thereby improving the printing performance of the refilled inkjet cartridge. It should be noted that certain steps of the process 1400 can be combined, omitted and/or rearranged from the example shown in FIG. 13.

Figure 15:
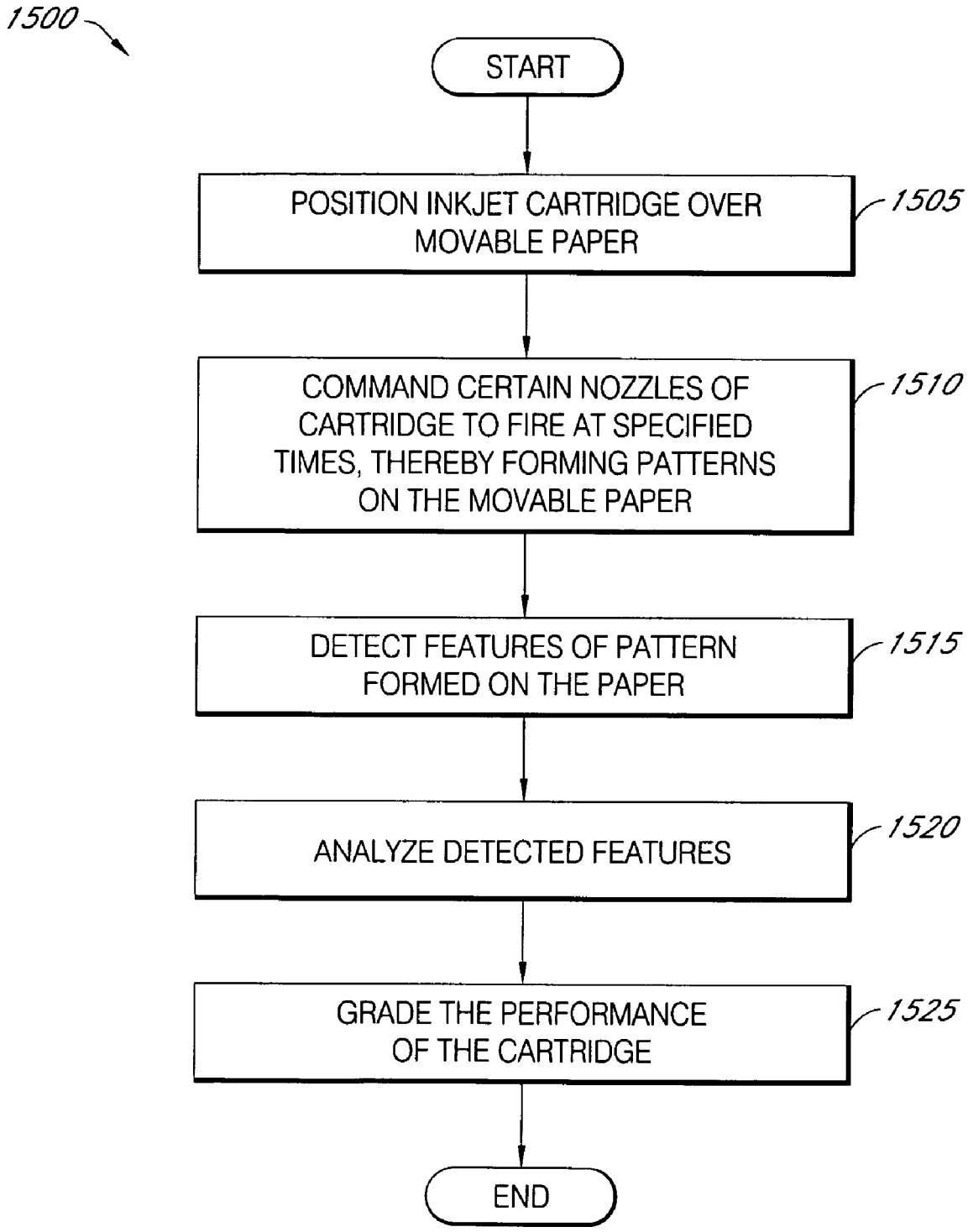
FIG. 15 is a flowchart of an embodiment of a process for testing an inkjet cartridge.

FIG. 15 is a flowchart of an embodiment of a process for testing an inkjet cartridge. The process 1500 can be performed using the testing station 75 of the system 10 shown in FIG. 1 and in FIGS. 10 and 11. As discussed above in reference to FIGS. 1, 10 and 11, the test fixture or receiver (78 in FIG. 1, and 1010 in FIG. 10) is configured to electrically connect to a plurality of cartridge adapters or fixtures 1000. The fixtures 1000 are configured to accept and electrically connect to certain configurations of inkjet cartridges. Electronics are connected to the receiver and are configured to cause drops of fluid to be ejected from specific nozzles of the inkjet cartridge. A sensing device can then detect which nozzles of the inkjet cartridge are ejecting drops of fluid. The example process 1500 uses a sensing device configured to detect features of patterns formed on a piece of paper and analyzes the detected features to grade the tested inkjet cartridge. Other embodiments of sensing devices and analyses are discussed below.

The process 1500 starts by positioning an inkjet cartridge over a movable paper at step 1505. In some embodiments, the cartridge is secured in a fixture or adapter (e.g., fixture 1000 of FIGS. 10 and 11). In one embodiment, the movable paper is a roll of paper configured to be fed under the cartridge while the process 1500 is being performed.

When the cartridge is in the fixture, it is electrically connected to one or more testing modules (e.g., testing module 1012 of FIG. 10), via a receiver that is configured to accept multiple adapters or test figures for multiple cartridge configurations. The process 1500 proceeds to step 1510 where the electronics and/or test modules command certain nozzles of the cartridge to fire at specific times, thereby forming patterns on the movable paper. By specifying the order and times in which the individual nozzles are commanded to fire, the patterns formed on the paper can be analyzed to determine if the specified nozzle fired at the specified time.

After commanding the cartridge to form the patterns on the paper at step 1510, the process 1500 proceeds to step 1515 where the patterns formed on the paper are detected, e.g., by a sensing device such as, for example, an optical scanner, a line scanner, an optical imaging device, etc. The sensing device can detect the ink spots on the paper and form a signal representing the detected patterns or features. The signal formed by the sensing device can be stored into memory such as by a computer configured to receive signals from the sensing device. In some embodiments, the sensing device is configured to detect a color mix of the patterns formed on the paper. This enables the process 1500 to be used for inkjet cartridges with multiple colors.

At step 1520, the features detected by the sensing device are analyzed. A computer that is configured to receive the signal from the sensing device can use one or more analysis modules, e.g., the image analysis test module 1040 of FIG. 10, to analyze the signal representing the patterns formed on the paper. In some embodiments, the computer is configured to identify a misfiring of a nozzle. A misfiring may mean that the nozzle is clogged or that it is misaligned. The analysis modules are configured to look for specified patterns formed at specified locations in the signal generated by the sensing device depending on how the nozzles were commanded to fire in step 1510. By knowing the speed that the paper is fed under the sensing device, knowing the nozzle locations that should have fired, and knowing the specified timing that the specified nozzles were commanded to fire, the analysis module can identify if the patterns represented by the signal generated by the sensing device properly match the expected patterns. In this way individual nozzle misalignment and or misfiring can be identified.

In some embodiments, the expected pattern analyzed at step 1520 comprises one or more lines formed by a continued firing of one or more of the nozzles. In these embodiments, the computer is configured to detect a defective nozzle by analyzing the signal received from the sensing device and to identify a break in the one or more lines. A break in a line can be indicative of a nozzle that is clogged occasionally or sporadically.

When the analyses of the detected features of step 1520 are completed, the process 1500 continues to step 1525 where the performance of the tested cartridge is graded using one or more grading thresholds. The grade of the cartridge will depend on the results of the analyses performed in step 1520. Some threshold levels of misfiring, misaligned and/or defective nozzles can be tolerated. A computer is configured to compare the results of the analysis to the tolerable threshold levels, the tested cartridges can be given a passing or failing grade (or other multiple grade levels including 3 or more levels of acceptability/performance).

In some embodiments, the computer is configured to identify a percentage of nozzles of the inkjet cartridge that are not firing, misaligned, clogged or defective in some other way. This percentage is then compared to a maximum non-firing (or misaligned, clogged or defective in some other way) threshold level (e.g. no more than 2%, 3%, 4%, 5%, etc.). If the percentage exceeds the threshold, then it is given a failing grade. If the percentage of non-firing nozzles is less than the maximum non-firing threshold level, then the cartridge is given a passing grad.

In other embodiments, a higher level (e.g., 5% or higher) of nozzle defects may be acceptable if the defective nozzles are not grouped together. In these embodiments, the computer grading the system is configured to identify a percentage of nozzles within a subset of nozzles that are defective. Preferably, the subset of nozzles are located near each other. The threshold percentage of tolerable defective nozzles within the subset of nozzles will depend on the type of cartridge and the quality of printing to be produced by the cartridge. Those of skill in the art can determine, without undo experimentation, acceptable threshold levels of nozzles grouped together. For example, a tolerable level may be that no adjacent nozzles are both defective (a 50% threshold), or one out of 3 adjacent nozzles (a 33% threshold), or one out of 4 adjacent nozzles (a 25% threshold) and so on. If the percentage of defective nozzles detected within each subset of nozzles is less than the chosen tolerable threshold, then the cartridge is given a passing grade, otherwise it is given a failing grade. The computer may be configured to determine how close each of the misfiring or defective nozzles are to each other and to lower the tolerable percentage if the nozzles are within a predetermined distance from each other. It should be noted that multiple grading methods may be combined where all or a certain number of the grading methods must result in a passing grade before the cartridge is given an overall passing grade. Other combinations of grading systems will be apparent to those of skill in the art.

It should be realized that embodiments of the methods for testing the inkjet cartridges are not limited to the particular configuration of forming test patterns on paper. Other configurations for determining nozzle functionality are also contemplated. For example, detection of in-flight measurements and acoustic detection may also be used. In-flight measurement can utilize an optical system which visually detects individual ink droplets fired from individual nozzles as they are ejected from the cartridge. Acoustic detection can utilize one or more microphones used to detect an audible signal generated when an ink droplet is ejected from a cartridge nozzle or impacts a test surface. In either case, the testing system controls which nozzle is fired, and when each nozzle if fired. By synchronizing the timing of when a specified nozzle should be detected, the acoustic and/or optical signals generated by the acoustic and/or optical sensing device can be analyzed to identify defective nozzles that are not detected to have fired or to have fired sporadically.

The foregoing description details certain embodiments of the invention. It will be appreciated, however, that no matter how detailed the foregoing appears in text, the invention can be practiced in many ways. As is also stated above, it should be noted that the use of particular terminology when describing certain features or aspects of the invention should not be taken to imply that the terminology is being redefined herein to be restricted to including any specific characteristics of the features or aspects of the invention with which that terminology is associated. The scope of the invention should therefore be construed in accordance with the appended claims and any equivalents thereof.

What is claimed is:

1. An inkjet printer cartridge refilling system, comprising:

at least one rotary valve comprising a plurality of ports and a common port;

at least one pump in liquid communication with said common port of said at least one rotary valve;

at least two ink sources in liquid communication with the ports of the rotary valve, wherein the rotary valve is positionable so that the at least one pump can receive ink from one of the ink sources; and at least one dispensing line connected to at least one of the ports, wherein said dispensing line is configured to provide ink to an inkjet printer cartridge.

2. The refilling system of claim 1, further comprising an electronic control system configured to switch said at least one rotary valve to connect a first ink source from one of said ink sources to said common port.

3. The refilling system of claim 2, wherein said electronic control system is configured to activate said pump to withdraw ink from said first ink source through said common port.

4. The refilling system of claim 3, wherein said electronic control system is configured to switch said at least one rotary valve to connect said dispensing line to said common port after said ink is withdrawn from said first ink source.

5. The refilling system of claim 4, wherein said electronic control system is configured to deliver said withdrawn ink through said dispensing line into said inkjet printer cartridge.

6. The refilling system of claim 1, wherein said at least one pump is a syringe pump.

7. The refilling system of claim 6, wherein the syringe pump is controlled by a motor.

8. The refilling system of claim 7, wherein said system comprises three syringe pumps connected to the common port of three rotary valves.

9. The refilling system of claim 8, wherein said three syringe pumps are connected to a single motor which controls the movement of said syringe pumps.

10. The refilling system of claim 9, wherein said three syringe pumps connect to a transverse bar, and wherein said transverse bar connects to said motor.

11. The system of claim 1, wherein the at least one syringe pump comprises a backflush port located in a lower portion of the syringe pump.

12. The station of claim 1, wherein said at least one dispensing line is configured to deliver ink to said inkjet printer cartridge through at least one needle.

13. A method of refilling an inkjet printer cartridge, comprising:

activating a rotary valve to connect one of a plurality of ink sources to a syringe pump;

withdrawing ink from said ink source into said syringe pump;

activating said rotary valve to connect said syringe pump to an inkjet printer cartridge; and delivering said ink to said inkjet printer cartridge.

14. The method of claim 13, wherein said rotary valve is actuated by an electronic control system.

15. The method of claim 13, wherein withdrawing ink from said ink source comprises activating a motor that moves said syringe pump.

16. The method of claim 13, wherein activating said rotary valve to connect the syringe pump to an inkjet printer cartridge comprises activating said rotary valve so that it connects said syringe pump to a transparent tubing that connects to a needle.

17. The method of claim 13, wherein activating said rotary valve to connect the syringe pump to an inkjet printer cartridge comprises activating said rotary valve so that it connects said syringe pump to an inkjet printer cartridge nozzle filling station.

18. An inkjet printer cartridge refilling system, comprising:

means for activating a rotary valve to connect one of a plurality of ink sources to a syringe pump;

means for withdrawing ink from said ink source into the syringe pump;

means for activating said rotary valve to connect said syringe pump to an inkjet printer cartridge; and means for delivering said ink from the syringe pump to said inkjet printer cartridge.

19. The inkjet printer cartridge refilling station of claim 18, wherein said means for activating a rotary valve comprises an electronic control system.

20. The inkjet printer cartridge refilling station of claim 18, wherein said means for withdrawing ink from said one of a plurality of ink sources comprises a syringe pump.

21. The inkjet printer cartridge refilling station of claim 18, wherein said means for delivering ink comprises a needle.

22. The inkjet printer cartridge refilling station of claim 18, wherein said means for delivering ink comprises an inkjet printer cartridge refilling station.

* * * * *